US006533648B2

(12) United States Patent
Drees

(10) Patent No.: US 6,533,648 B2
(45) **Date of Patent: *Mar. 18, 2003**

(54) SURFACE PREPARATION DEVICE

(76) Inventor: Edward Drees, 14020 Orange Ave., Paramount, CA (US) 90723

( * ) Notice: Subject to any disclaimer, the term of this patent is extended or adjusted under 35 U.S.C. 154(b) by 0 days.

This patent is subject to a terminal disclaimer.

(21) Appl. No.: 09/741,630

(22) Filed: Dec. 19, 2000

(65) Prior Publication Data

US 2001/0003085 A1 Jun. 7, 2001

Related U.S. Application Data

(63) Continuation-in-part of application No. 09/166,710, filed on Oct. 5, 1998.

(51) Int. Cl.[7] ..... B24B 7/00
(52) U.S. Cl. ..... 451/182; 451/270; 451/166
(58) Field of Search ..... 451/182, 166, 451/167, 172, 139, 270, 127, 184; 408/47

(56) References Cited

U.S. PATENT DOCUMENTS 4,478,010 A * 10/1984 Dicke ..... 51/170 TL
5,081,794 A * 1/1992 Haney ..... 51/60
6,200,206 B1 * 3/2002 Drees ..... 451/270

* cited by examiner

*Primary Examiner*—Timothy V. Eley
*Assistant Examiner*—Dung Van Nguyen
(74) *Attorney, Agent, or Firm*—J. E. Brunton

(57) ABSTRACT

A production type surface finishing apparatus for finishing the surfaces of workpieces such as cabinet doors and the like which include a plurality of relatively large, very lightweight finishing platens that are simultaneously movable in both a reciprocal and an orbital-like motion. The platen is moved in a reciprocal motion by a first motion-imparting mechanism and is simultaneously moved in a high-frequency, orbit-like motion by a second motion-imparting mechanism that includes shafts which are rotated at relatively high rates of speed. The shafts, and the motors which drive them, are mounted on platforms which are reciprocally movable relative to the main frame of the device. Connected to the rotating shafts by specially designed elastomeric sleeve-like members or yieldably deformable connector bands are specially configured, ring-like members. The rings are, in turn, connected to the platen assemblies by novel shaft and bearing assemblies.

20 Claims, 34 Drawing Sheets

72
63a
72
63
30
44
42
70d
64a
70c
205
54
70
75
78
74
76
70b
86a
136
138
139
134
88
57
86b
140
118
76
-56-
180
80
207
52
50
34
52
32
36

102
108
94
122
113
114
90
118
128
128a
D
154
158
156
170
-100-
36
-W-
184
171
-32-
80
189
188
190
180
178
166
162
181
18
23
172a
172b
174
W
172
176
175
156a
156b
156c

SURFACE PREPARATION DEVICE

This is a Continuation-In-Part application of U.S. Ser. No. 09/166,710 filed Oct. 5, 1998 U.S. Pat. No. 6,200,206.

BACKGROUND OF THE INVENTION

1. Field of the Invention

The present invention relates generally to surface preparation. More particularly, the invention concerns an improved surface preparation apparatus for forming a very fine surface on wooden workpieces such as cabinet doors and the like.

2. Discussion of the Prior Art

A number of different kinds of handheld as well as volume production type machines for preparing surfaces of various types of workpieces have been suggested in the past. These machines typically use a sanding belt entrained around a sanding platen. The major drawback of many of these machines is that they often leave unsightly cross-grain scratch patterns in the surface of the workpiece. Frequently hand sanders such as those disclosed in U.S. Pat. No. 4,478,010 issued to Dicke are used to remove the unacceptable cross-scratches. However, this process is very labor intensive, time consuming and expensive. Further, hand sanding generally fails to produce a uniform surface particularly on relatively large surfaces, such as cabinet doors.

In an attempt to overcome the aforementioned drawbacks of prior art sanding processes, various designs of production type apparatus having one or more oscillating sanding heads have been proposed. One such apparatus is described in U.S. Pat. No. 5,081,794 issued to Haney. The Haney patient describes a dual orbiting sanding apparatus that includes a frame a conveyor, first and second stepped drive shafts that support a brace and cause the brace to move in a first orbit. The apparatus further includes second and third stepped drive shafts that are supported by the brace and are connected to the platen to move the platen in a second orbit.

U.S. Pat. No. 2,787,100 issued to Peyches discloses a machine for grinding or polishing glass. More particularly, the patent describes a polisher wherein a slurry or suspension containing the abrasive grit is continuously fed into the machine as the work travels through the machine. While the machine produces a circular motion combined with a slow reciprocating motion, these motions are induced by totally different types of mechanisms from those of the apparatus of the present invention.

A German Patent No. 27 40 696 issued to Meyer concerns a grinder or polisher for grinding tombstones. The Meyer apparatus includes a bridge on which a grinding head is mounted. The grinding head powers a rotating disk grinder. In operation, the grinding head along with the disk grinder must traverse the entire face of a tombstone in order for polishing operation to be accomplished.

The present invention comprises an improvement of the apparatus disclosed in copending U.S. Ser. No. 09/166,710 filed Oct. 5, 1998. Because of the pertinence of this application, U. S. Ser. No. 09/166,710 is hereby incorporated by reference as though fully set forth herein.

In most of the prior art orbital sanders, the orbital, or oscillatory movement of the platen is accomplished using some type of stepped shaft or crank mechanism. Generally speaking in such devices, the higher the rate of rotation of the drive shafts, the better will be the performance of the sander. However, as the speeds of rotation increase bearing wear, including wear on bearings attached to the platen, can become excessive resulting in frequent bearing failure to mitigate against excessive platen bearing wear, the platen size of the sander must, of necessity, be kept small thereby limiting the effectiveness of the machine for use in high volume production processes. Stated another way, as the orbiting platen becomes larger and heavier, the size of the off-set bearing must be increased to withstand the tremendous forces created on the bearing as the platen orbits.

As will be better understood from the description that follows, the apparatus of the present invention uniquely overcomes the mechanical limitations inherent in prior art devices which embody crank or stepped shaft type drive mechanisms to obtain orbital movement of the platen by providing a highly novel orbit generating mechanism to produce a controlled orbital movement to the platen.

SUMMARY OF THE INVENTION

It is an object of the present invention to provide a surface preparing apparatus having a lightweight platen that simultaneously moves in both a high-speed orbital motion and a lower speed reciprocal motion in a manner that produces an extremely fine finish on the workpiece as the workpiece moves beneath the platen.

Another object of the invention is to provide an apparatus of the aforementioned character in which the platen is of a unique laminate construction having a very lightweight foam core so that the platen can be made sufficiently large to make the apparatus attractive for use in large-scale industrial processing operations.

Another object of the invention is to provide an apparatus of the type described in the preceding paragraph in which a novel abrasive carrying assembly is releasably connected to the lightweight platen of the apparatus by vacuum means. A sandpaper sheet is receivably affixed to the lower surface of the abrasive carrying assembly and when used up can be quickly and easily replaced with a new sheet thereby significantly reducing down time.

Another object of the invention is to provide an apparatus of the aforementioned character in which the orbit generating means for generating the orbital motion of the platen is coupled with the rotating shaft of the drive means of the apparatus by a novel elastomeric coupling mechanism.

Another object of the invention is to provide an apparatus as described in the preceding paragraph in which the orbit generating means further includes a novel orbit inducing ring-like member that is uniquely affixed to the elastomeric coupling mechanism.

Another object of the invention is to provide an apparatus as the described in which the workpiece is carried past the platen assembly by a fully automatic conveyor system.

Another object of the invention is to provide an apparatus which includes the advantages set forth in the preceding paragraphs and is also economical to construct, is easy to use by relatively unskilled operators, is very reliable in use, is of a simple design and requires minimum maintenance and offers a very long, useful life.

Still another object of the invention is to provide a surface preparing apparatus which is very fast and produces an extremely fine, high-quality surface on relatively large workpieces such as cabinet doors.

DESCRIPTION OF THE INVENTION

Figure 1A:
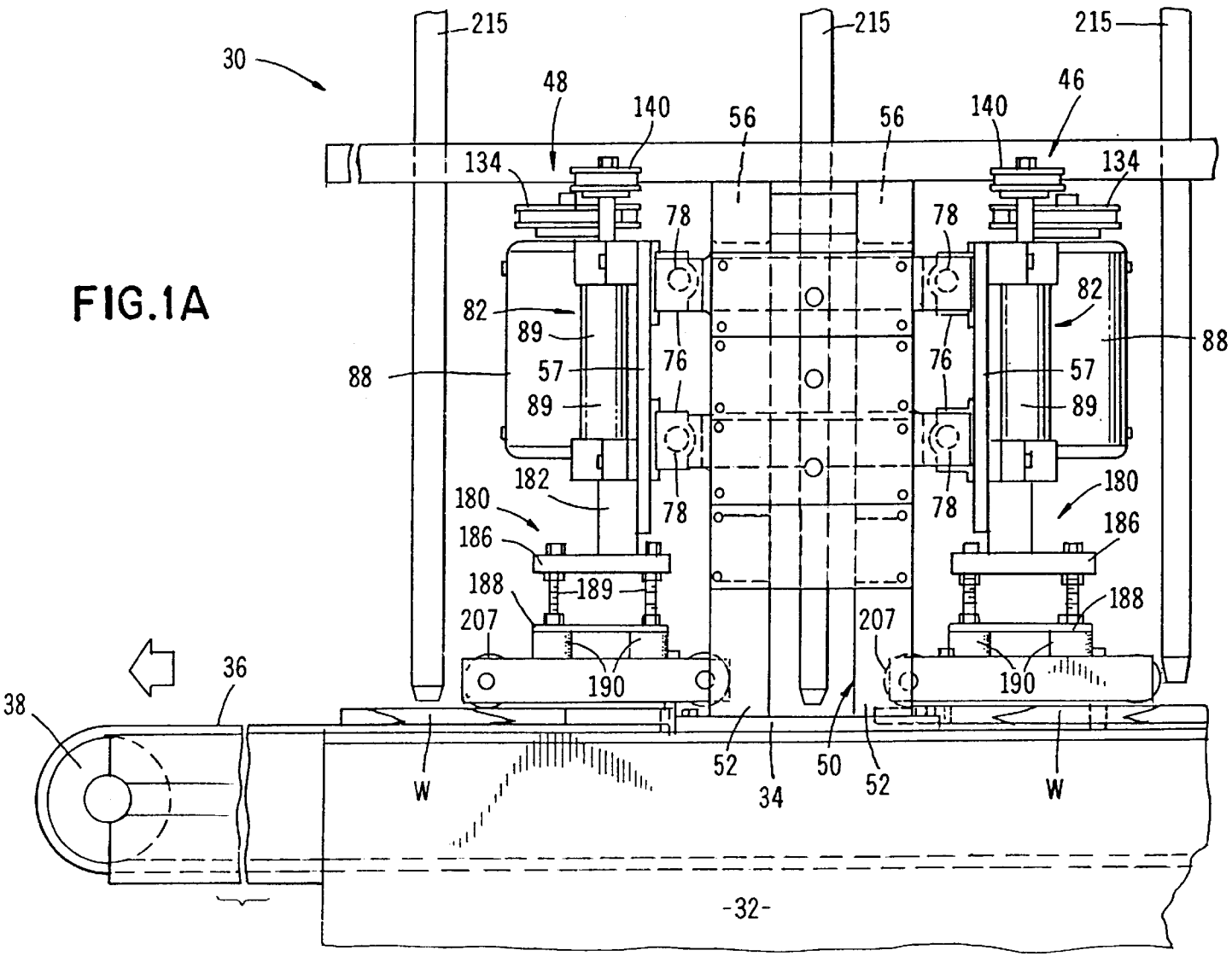
FIGS. 1A and 1B, when considered together, comprise a side-elevation view of one form of the surface preparation device of the present invention.
Figure 1B:
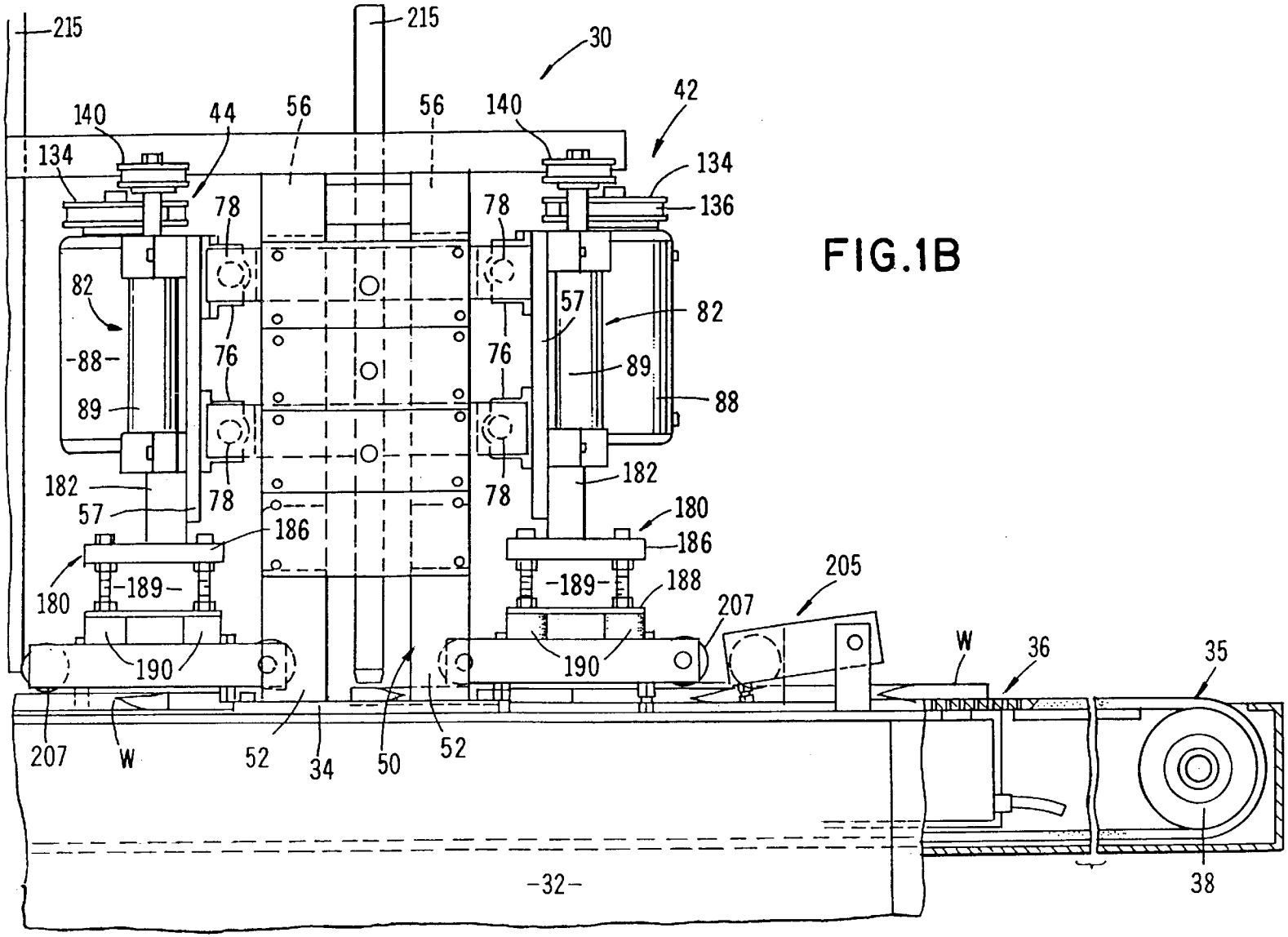
Figure 2A:
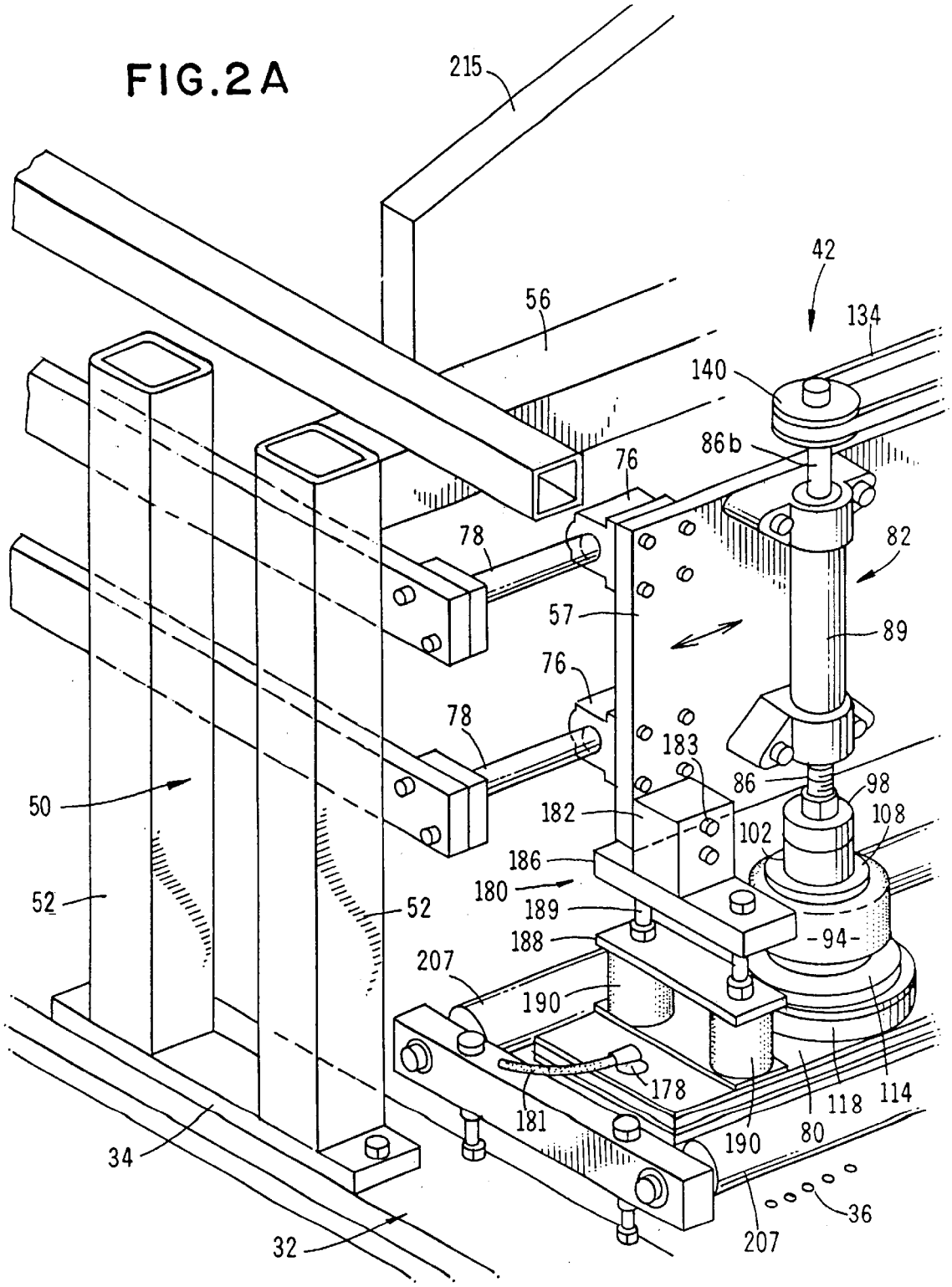
FIGS. 2A and 2B, when considered together, comprise a greatly enlarged, generally perspective view of one of the four surface finishing subassemblies of the invention.

Referring to the drawings and particularly to FIGS. 1A, 1B, 2A and 2B, the apparatus of one form of the surface preparing apparatus of the invention is there shown and generally designated by the numeral 30. The apparatus here comprises a stationary main frame 32 having transversely spaced-apart, generally horizontally extending mounting surfaces 34 (FIG. 2A). Connected to main frame 32 is a vacuum type conveyer subsystem 35 which includes a perforated endless conveyer belt 36. Belt 36 travels around rollers 38 provided at either end of the mainframe which rollers are driven in a conventional manner by an electric motor or other suitable drive means. In a manner presently to be described, belt 36 functions to transport the workpieces "W" (FIGS. 1A, 1B and 2) through the machine at a uniform rate. The vacuum type conveyor subsystem is of standard design and of a character well known to those skilled in the art.

The surface preparing apparatus itself includes four longitudinally spaced finishing subsystems 42,44, 46, and 48 (FIGS. 1A and 1B), each of which is of substantially identical construction. This being the case, the description of the construction of the first finishing subsystem 42 should be constructed as also describing the identical subsystems 44, 46, and 48.

Figure 2B:
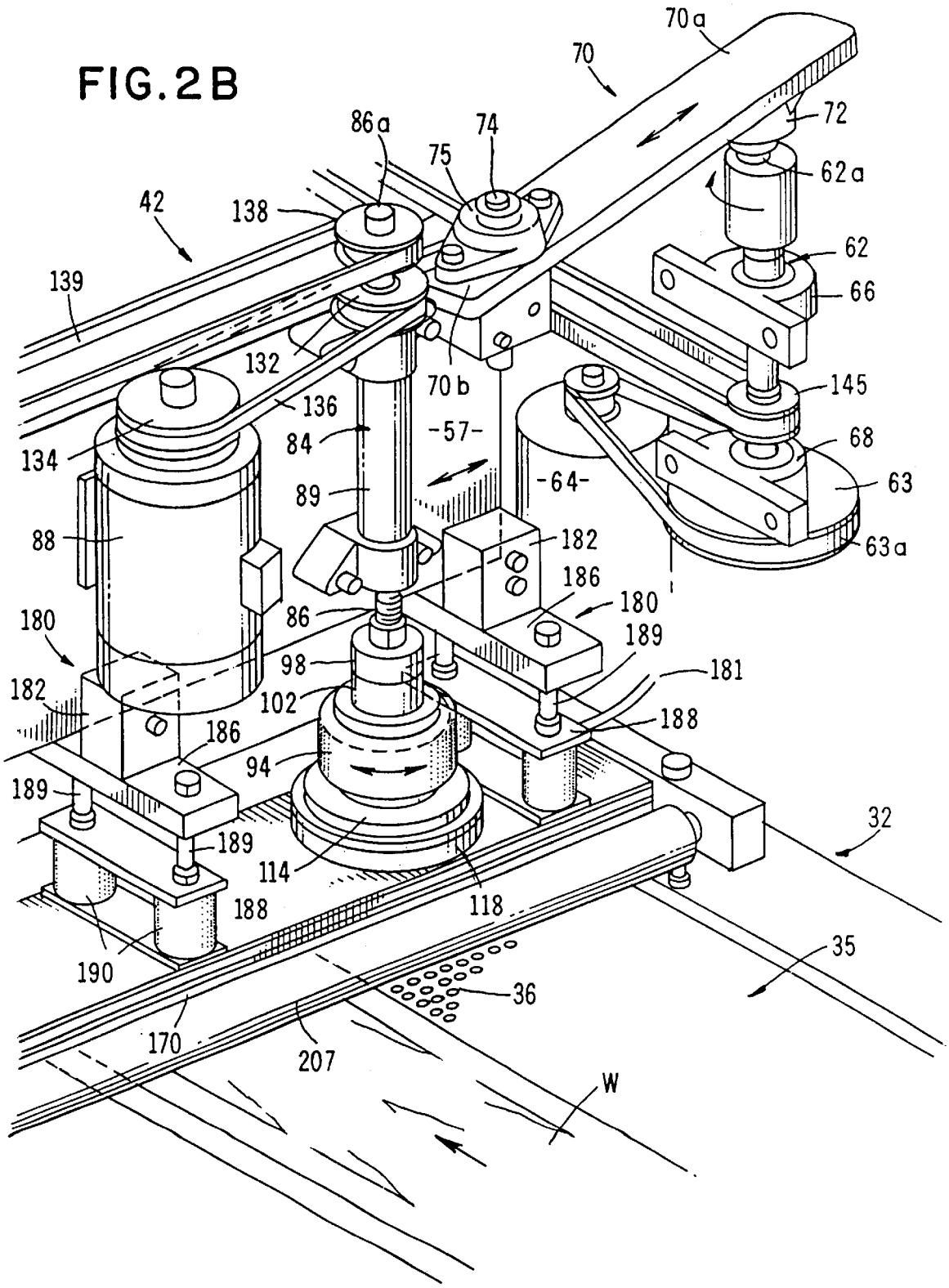

Turning particularly to FIGS. 2A and 2B, it can be seen that finishing subsystem 42 is supported by a fixed subframe 50, which is mounted on mainframe 32. Subframe 50 includes oppositely disposed, transversely spaced, generally vertically extending support columns 52 and 54 which are connected to the previously identified mounting surfaces 34. Subframe 50 also includes a generally horizontally extending support beam 56 which spans columns 52 and 54 (see also FIGS. 6A and 6B).

Figure 6A:
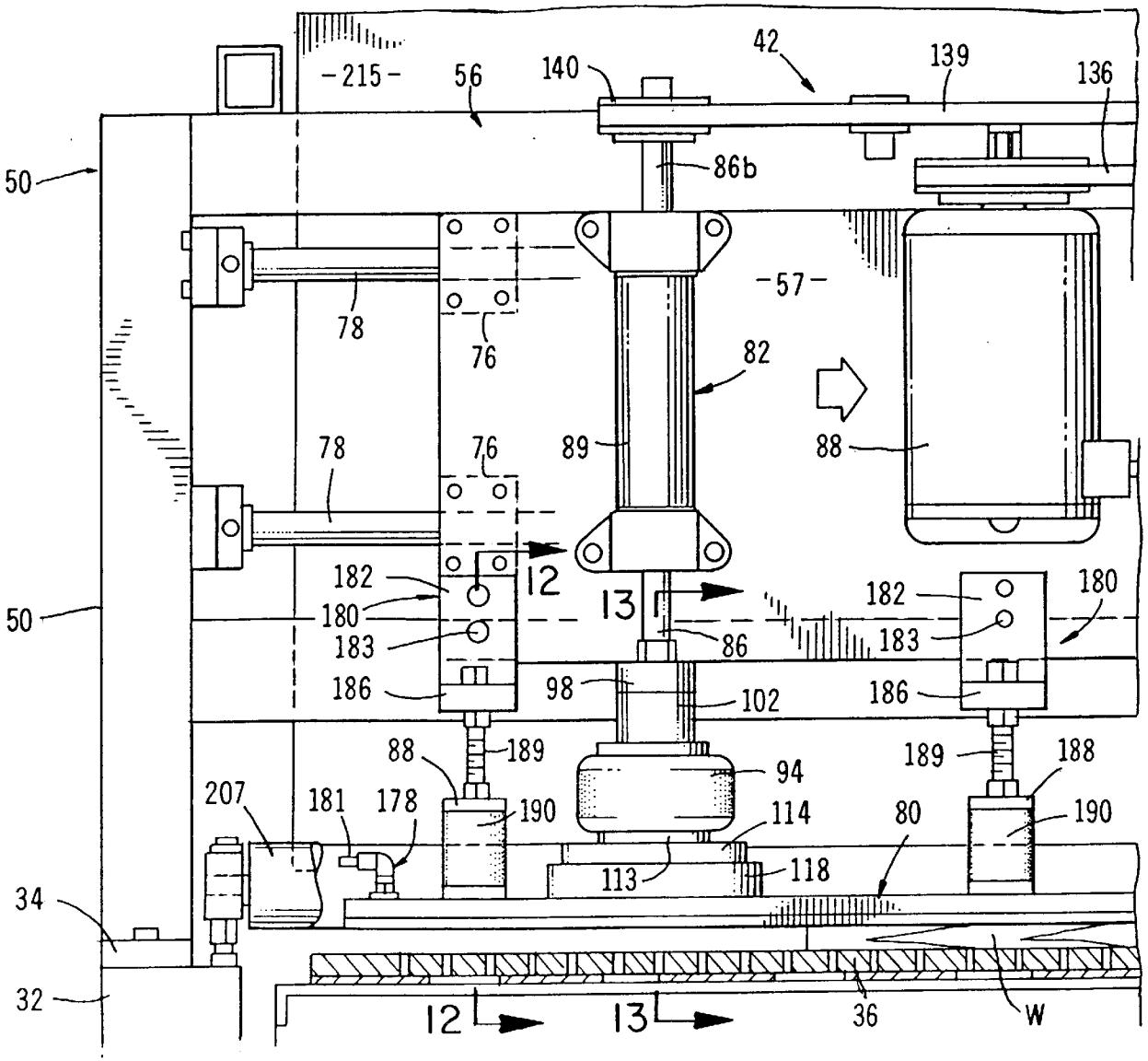
FIGS. 6A and 6B, when considered together, comprise a view taken along lines 6—6 of FIG. 4B.
Figure 7:
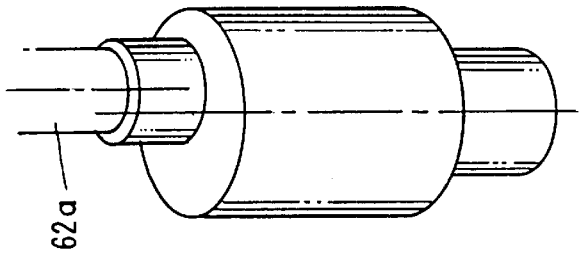
FIG. 7 is a generally perspective, fragmentary view of one of the crank shafts of the apparatus shown in FIG. 6B for inducing a reciprocal motion to the platen.
Figure 8:
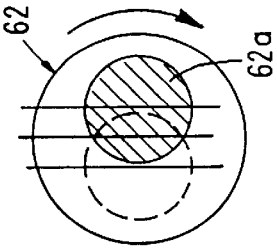
FIG. 8 is a top plan view of the crank shaft shown in FIG. 7.
Figure 6B:
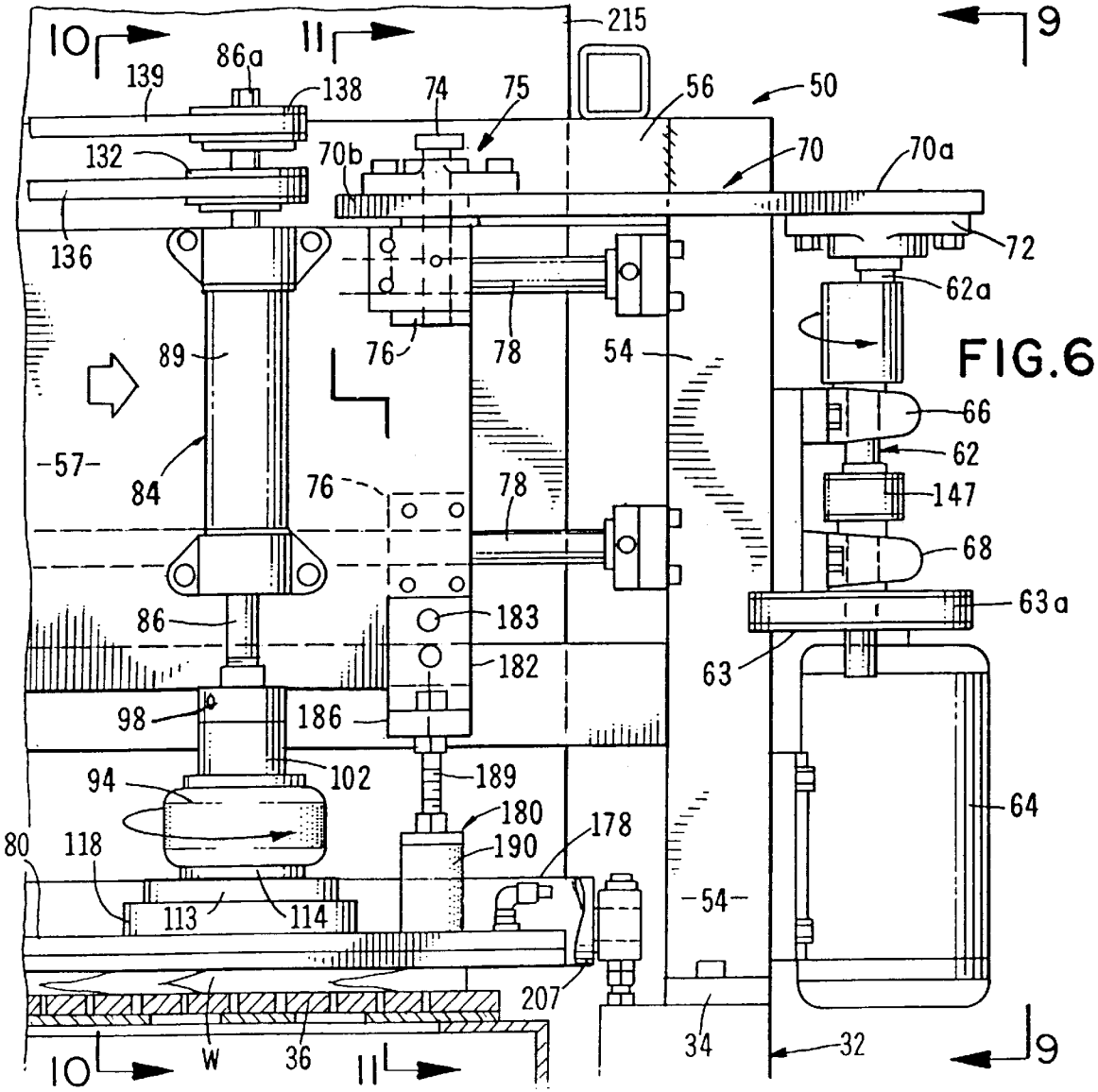

Subframe 50 supports a first motion-imparting means or reciprocating means, which imparts a transverse reciprocating movement to a transversely extending support platform 57 to which a platen assembly to is connected in a highly novel manner (see FIGS. 2A, 6A, and 6B). Referring particularly to FIGS. 2B and 6B, the first motion-imparting means includes a crank shaft 62 which is controllably rotated by an electric motor 64 within spaced-apart bearings 66 and 68 which are connected to subframe 50 in the manner best seen in 6B of the drawings. Motor 64 drives shaft 62 via a driven sheave 63 which is connected to shaft 62 and a drive belt 63*a* (FIG. 2B). Interconnecting shaft 62 which platform 57 is connector member shown here as an arm 70 having first and second ends 70*a* and 70*b*. First end 70*a* is connected to the upper, radially off-set end 62*a* of shaft 62 by a bearing 72, while end 70*b* is connected to platform 57 by a shaft 74 and bearing assembly 75.

Connected to platform 57 are four spaced-apart bearing assemblies 76 which are adapted to slide along a pair of spaced apart guide rods 78 which span subframe 50 (FIGS. 6A and 6B). More particularly, as shown in FIGS. 6A and 6B, guide rods 78 are connected proximate their ends to columns 52 and 54 of subframe 50. With the construction described in the preceding paragraphs, reciprocal movement of platform 57, along with a novel platen assembly 80, which is connected to platform 57, along with a novel platen assembly 80, which is connected to platform 57, is accomplished by the first motion imparting means of the character described.

Also connected to platform 57, is the important second motion-imparting means, or orbit generators 82 and 84 of the invention for moving the platen assembly in a orbital-like motion.

Figure 13:
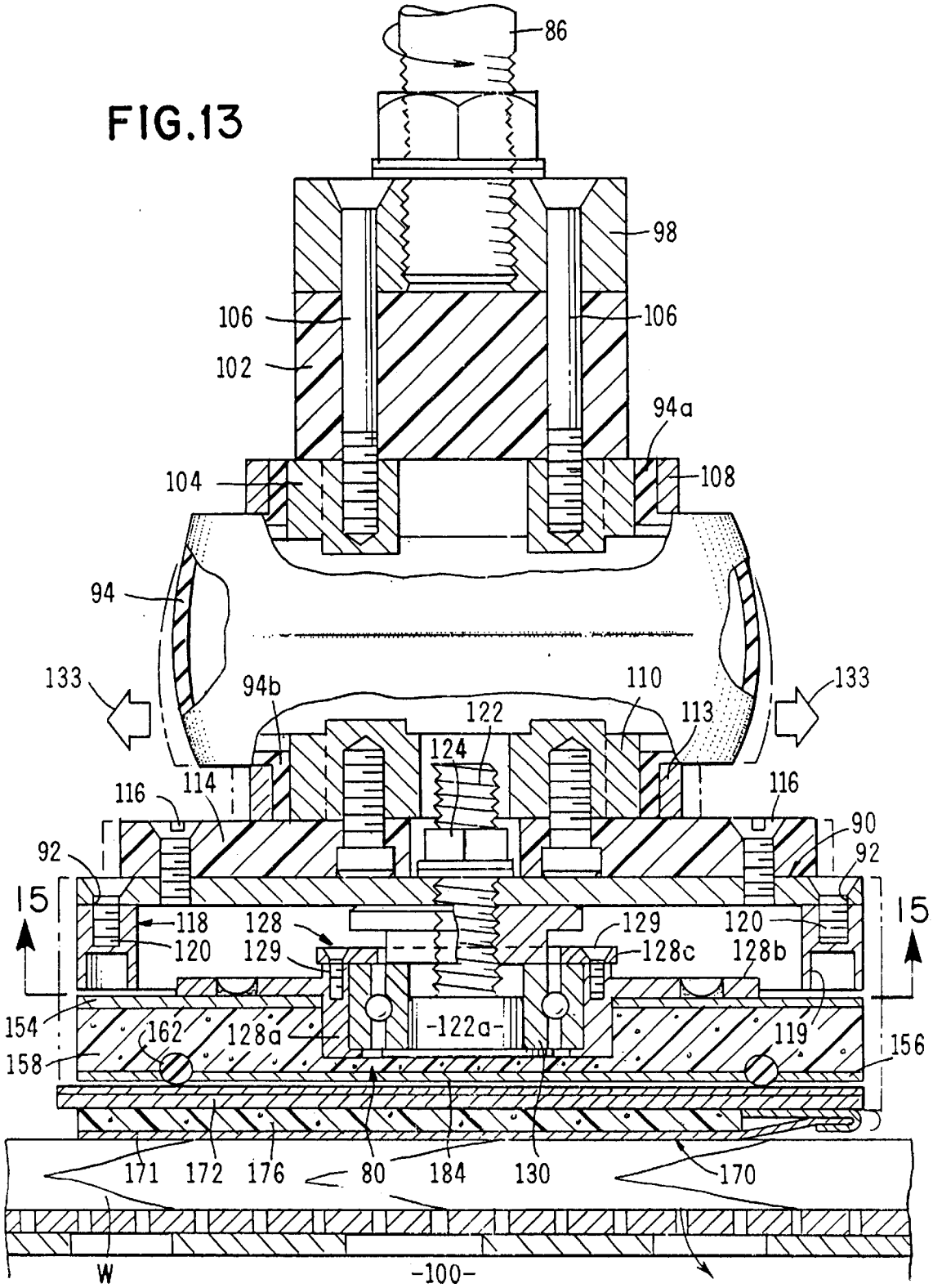
FIG. 13 is an enlarged, cross-sectional view taken along lines 13—13 of FIG. 6A.
Figure 14:
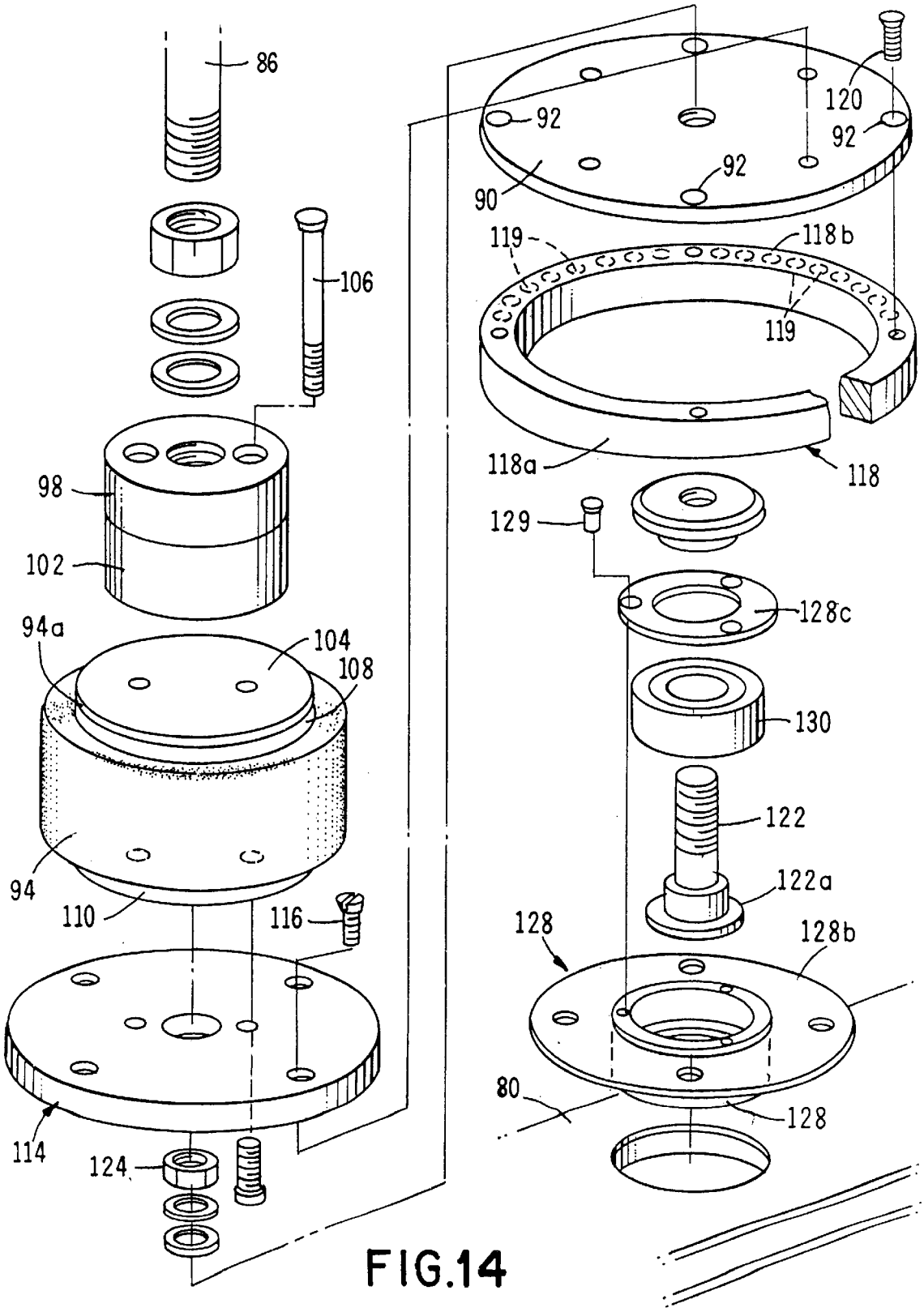
FIG. 14 is an enlarged, generally perspective exploded view of one form of the vibratory motion imparting means of the apparatus of the invention.
Figure 15:
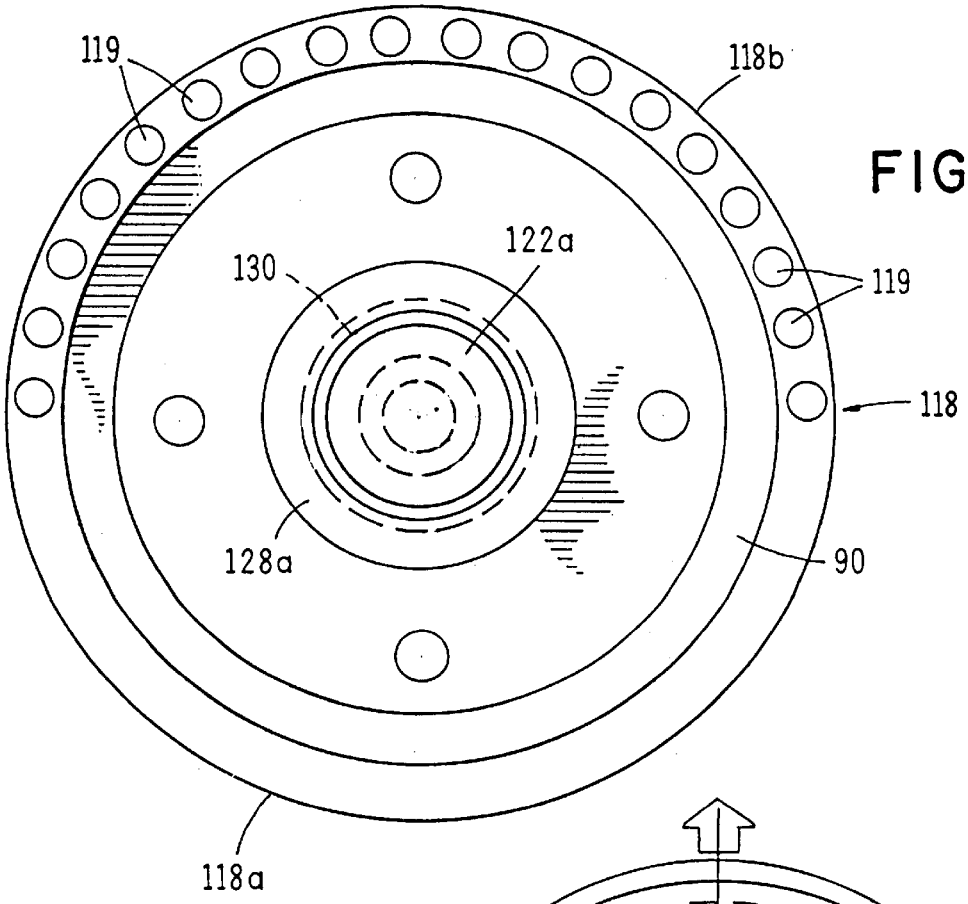
FIG. 15 is an enlarged view taken along lines 15—15 of FIG. 13.

Referring next to FIGS. 13, 14, and 15, each of the orbit generators 82 and 84 of this important second motion-imparting means can be seen to comprise a rotating shaft 86 and novel interface means for interconnecting shaft 86 with an aperture ring 118. As best seen by referring to FIG. 14, ring 118 includes a peripheral portions 90*a* having a plurality of circumferentially spaced bores 119, the purpose of which will presently be described.

The novel interface means of the invention comprises a generally annular shaped, hollow sleeve-like elastomeric member 94 which is disposed between rotating shaft 86 and plate 90 in a manner best seen in FIG. 13. Member 94 is interconnected with shaft 86 by a first connector means and is interconnected with plate 90 by a novel second connector means. First connector means here comprises a first connector block 98 that is threadably connected to shaft 86 connector block 98 is, in turn, connected to a second connector block 102 which, is connected to a connector plate 104 by means of elongated threaded connectors 106 (FIG. 14). Connector plate 104 is connected to a collar-like portion 94*a* formed on member 94 by means of a clamping ring 108.

As previously mentioned, the second connector means of the invention functions to interconnect annular shaped sleeve 94 with plate 90. As best seen in FIG. 13, this second connector means here comprises a connector plate 110 which is interconnected with elastomeric member 94 by a clamping ring 113 which clamps a lower collar-like portion 94*b* of member 94 against plate 110. A second connector plate 114 is also interconnected with plate 90 by means of threaded connectors 116. Interconnected with plate 90 and extending downwardly therefrom is an apertured ring-like member 118. Member 118, that is connected with plate 90 by threaded connectors 120 which are received within bores 92. As shown in FIG. 15, apertured ring 118 has first and second peripheral portions 118*a* and 118*b*. Importantly portion 118*a* has a plurality of circumferentially spaced bores 119, the purpose of which will presently be described.

Operably associated with apertured ring 18 and forming a part of the second motion-imparting means of the invention, is a third connector means for operably interconnecting plate 90 with platen assembly 80. This third connector means comprises a threaded shaft 122 and a nut 124 which functions to connect plate 90 to rotating shaft 122 in the manner shown in FIG. 13. As also indicated in FIG. 13, shaft 122 is provided proximate its lower extremity with a generally cylindrically shaped head portion 122*a*. Head portion 122*a* is journaled within first bearing means, which, in turn, is mounted within a housing 128 which comprises a cup-like body portion 128*a* that extends into the core of platen assembly 80. Body portion 128*a* includes a flange 128*b* that is connected to the upper surface of platen surface of platen assembly 80. A cover 128*c* is connected to flange 128*b* by connectors 129 and functions to retain bearing 130 of the first bearing means within cup-like body 128*a*.

With the construction described in the preceding paragraph, rotation of shaft 86 by motor 88 will impart rotation to plate 90 and to apertured ring 118 which is attached thereto. Rotation of plate 90 will impart rotation to shaft 122, the head portion 122*a* of which is rotatably supported within bearing 130. Because ring member 118 is formed of a relatively heavy material, such as a brass or bronze, the plurality of holes formed in peripheral portion 118*a* causes a substantial vibratory motion as plate 90 and an apertured ring 118 are rapidly rotated. This vibratory motion is transmitted to bearing 130 and to platen assembly 80 causing a novel circular, orbit-like motion to be imparted to the platen assembly. In a manner presently to be described, this orbit-like motion coupled with the reciprocal motion of the platen assembly performs a superior finishing operation on the material residing beneath the platen with which the platen is in engagement. As apertured ring 118 rapidly rotates and vibrates due to the uneven weight distribution caused by bores 119, elastomeric sleeve 94 of the interfacing means will also uniquely vibrate in a circular, orbit-like motion as indicated by guide arrows 133 of FIG. 13. Sleeve 94 functions to transfer rotary motion from shaft 86 to the vibratory mechanism and also to isolate shaft 86 from vibration.

Turning once again to FIGS. 2A, 6A and 6B, it is to be noted that the transversely spaced apart second motion imparting means or orbital generators 82 and 84 are of the identical construction as described in the preceding paragraphs. Disposed intermediate orbital generators 82 and 84 is an electric motor 88 which comprises the means for rotating shafts 86 of both of the orbital generators which shafts are rotatably connected to platform 57 by bearing assemblies 89. More particularly, shaft 86 of the right generator as viewed in FIG. 2A carries a first sheave 132 which is connected to sheave 134 of motor 88 by a drive belt 136. A second upper sheave 138 is also mounted on shaft 84 and is interconnected with a sheave 140 mounted on shaft 84*b* of the left-hand orbital generator assembly by a belt 139. With this construction, motor 88 will simultaneously rotate shafts 84*a*and 84*b* of the adjacent orbital generators 82 and 84 causing an orbital motion to be imparted to platen assemblage 80. At the same time, the first motion imparting means will import a reciprocal motion to the platen assembly.

As previously mentioned, the surface preparing apparatus of the invention includes four longitudinally spaced surface finishing subsystems, each of which is substantially identical to surface finishing subsystem 42. As shown in FIGS. 1A and 1B, the four surface finishing subsystems 42, 44, 46 and 48 are disposed above the conveyor belt 36 of the vacuum type conveyor system of the invention and are longitudinally spaced along the length thereof. Each of these finishing subsystems includes a platen assembly 80, a first motion imparting means for imparting reciprocal motion to the platen assembly and a second motion imparting means for imparting an orbit-like motion to the platen system.

Figure 4A:
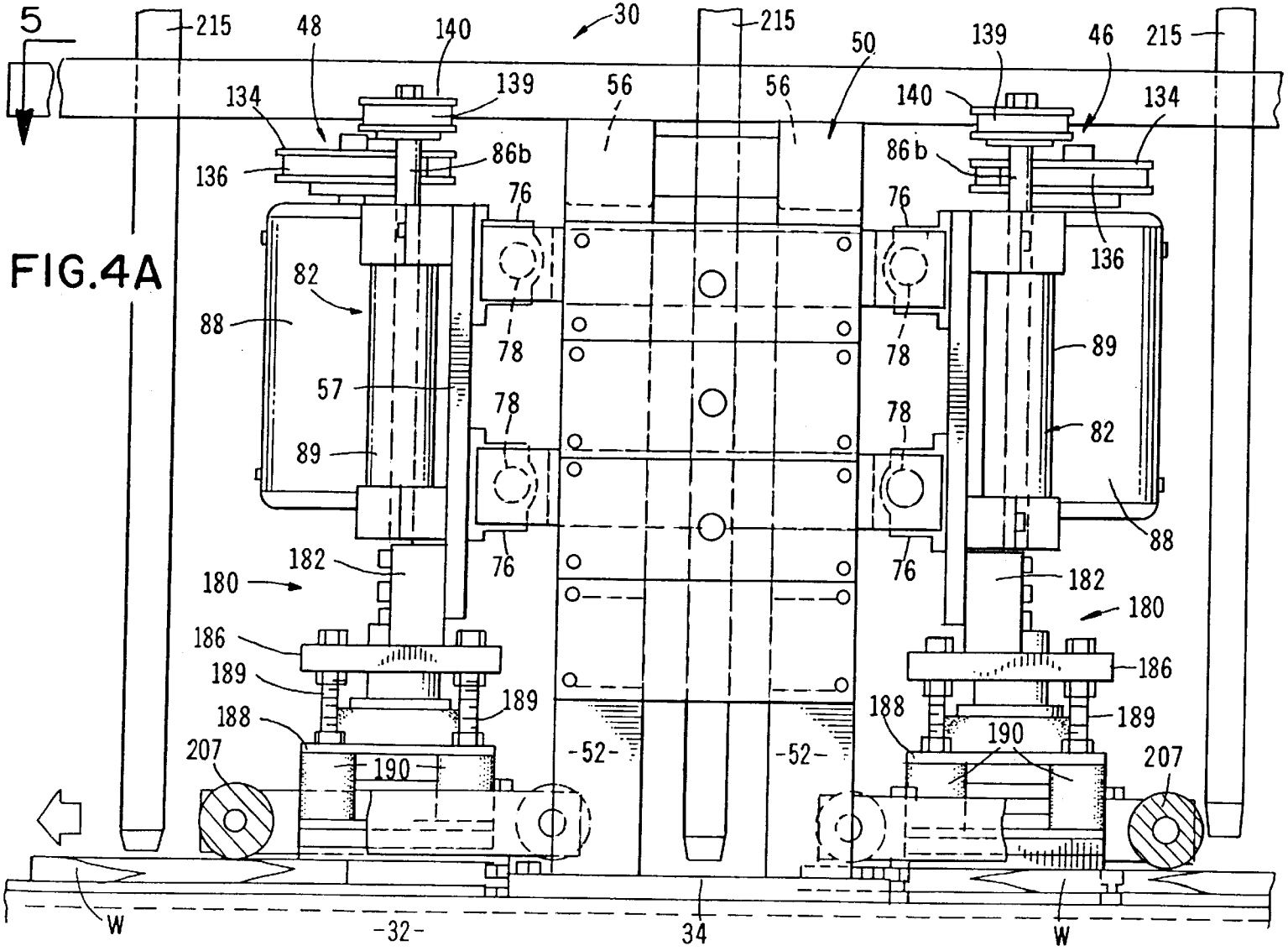
FIGS. 4A and 4B, when considered together, comprise an enlarged side-elevational view of the four finishing subassemblies of the invention partly broken away to show internal construction.
Figure 4B:
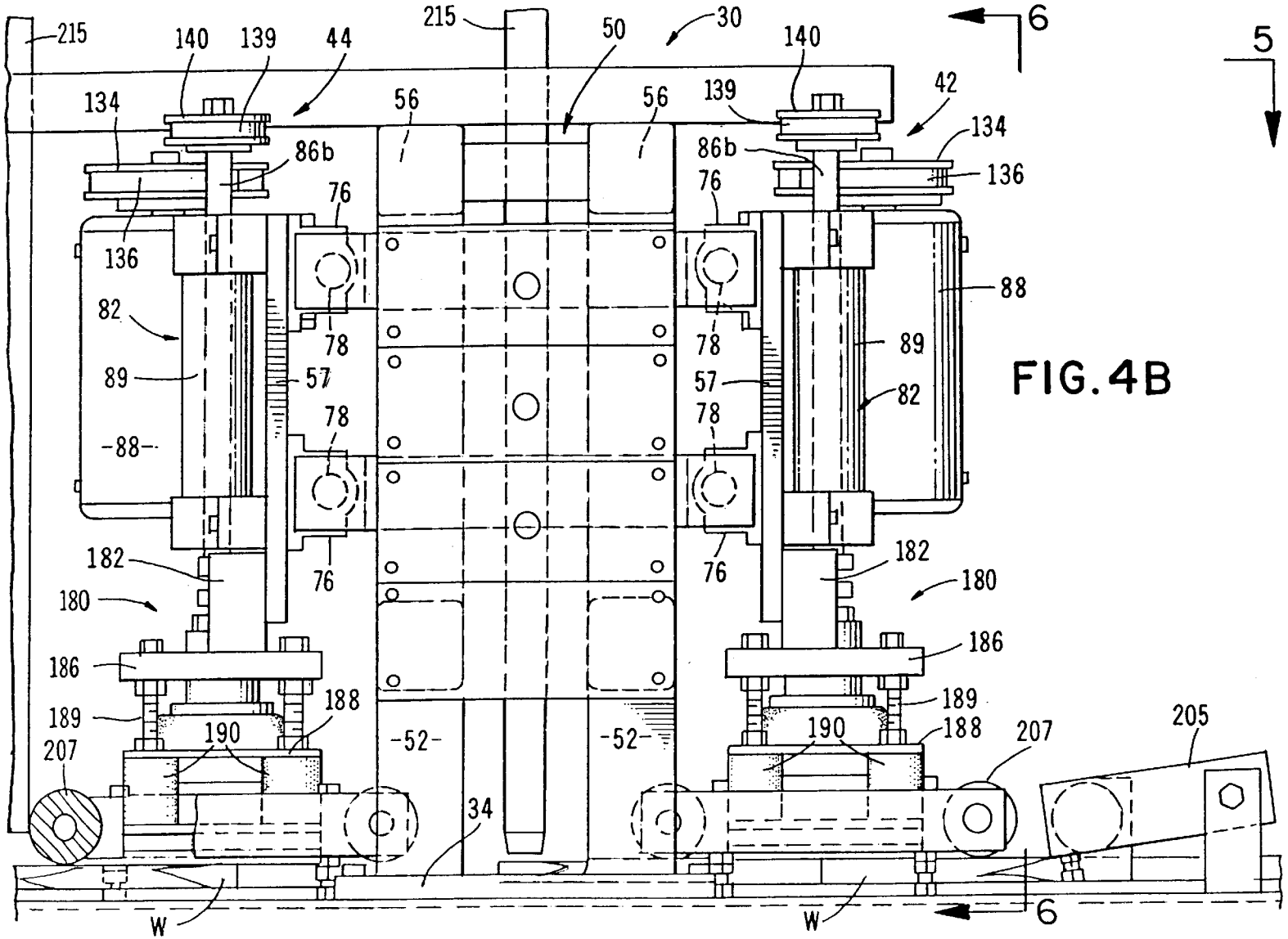
Figure 5A:
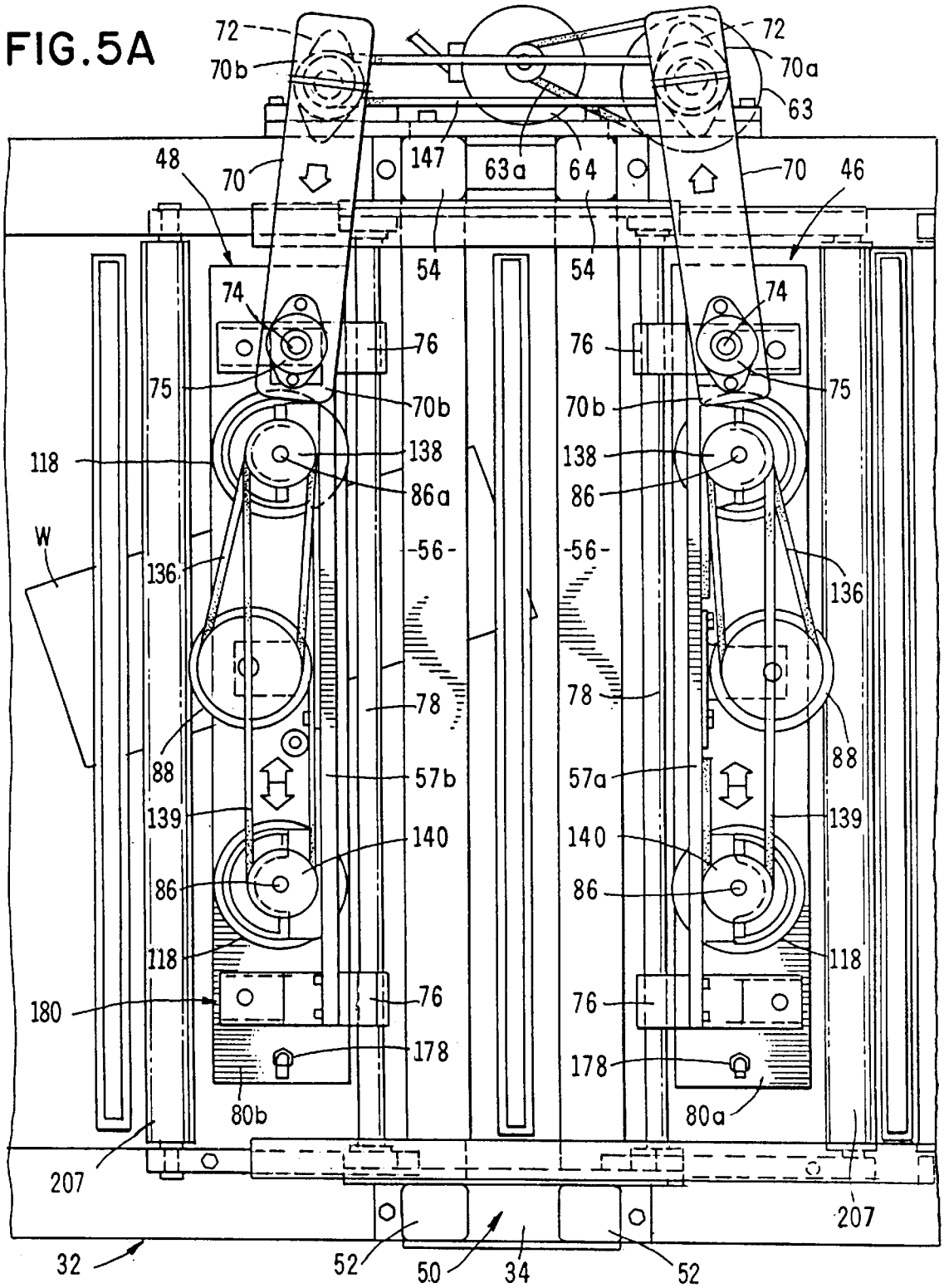
FIGS. 5A and 5B, when considered together, comprise a view taken along lines 5—5 of FIGS. 4A and 4B.
Figure 5B:
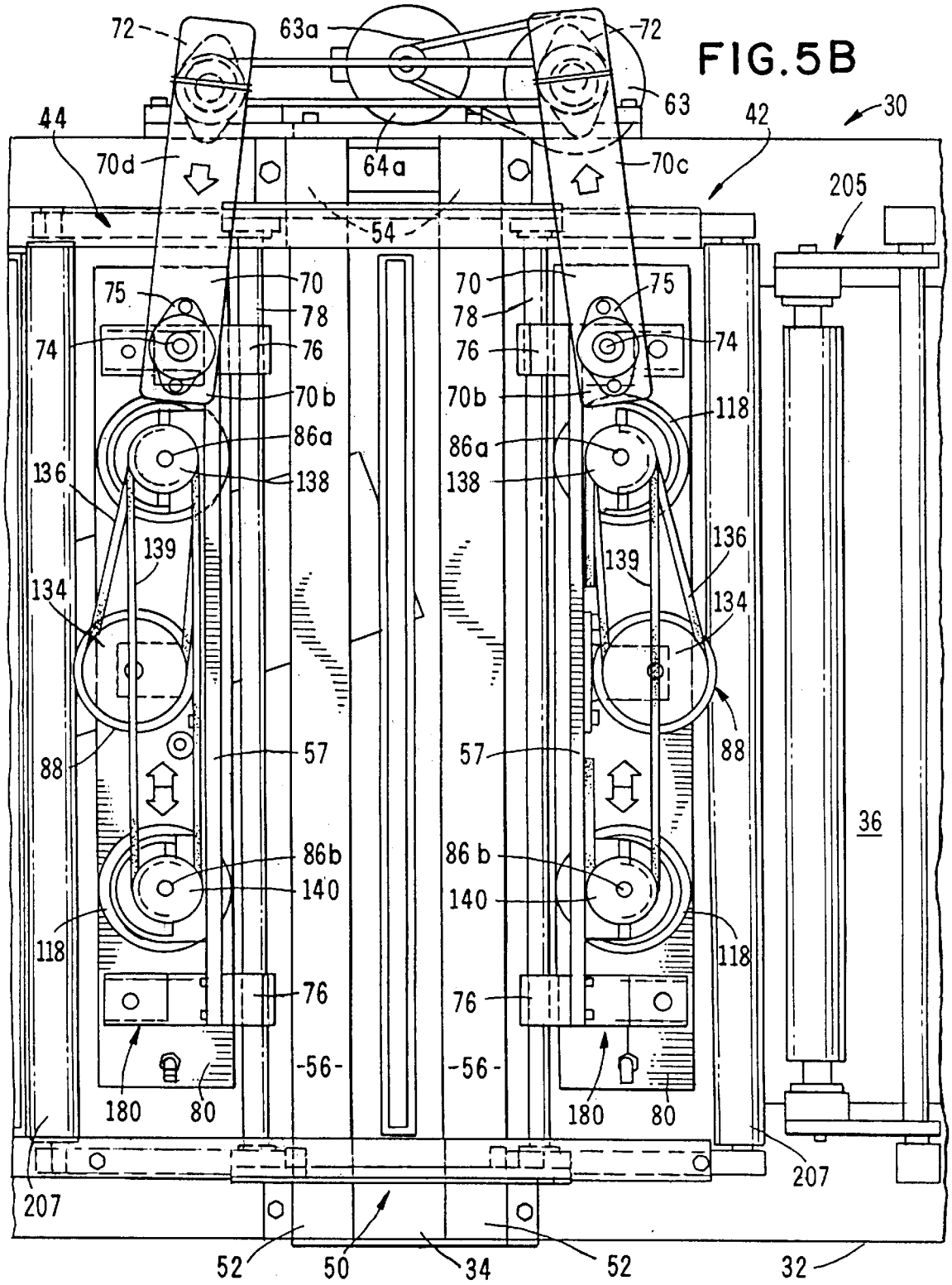
Figure 9A:
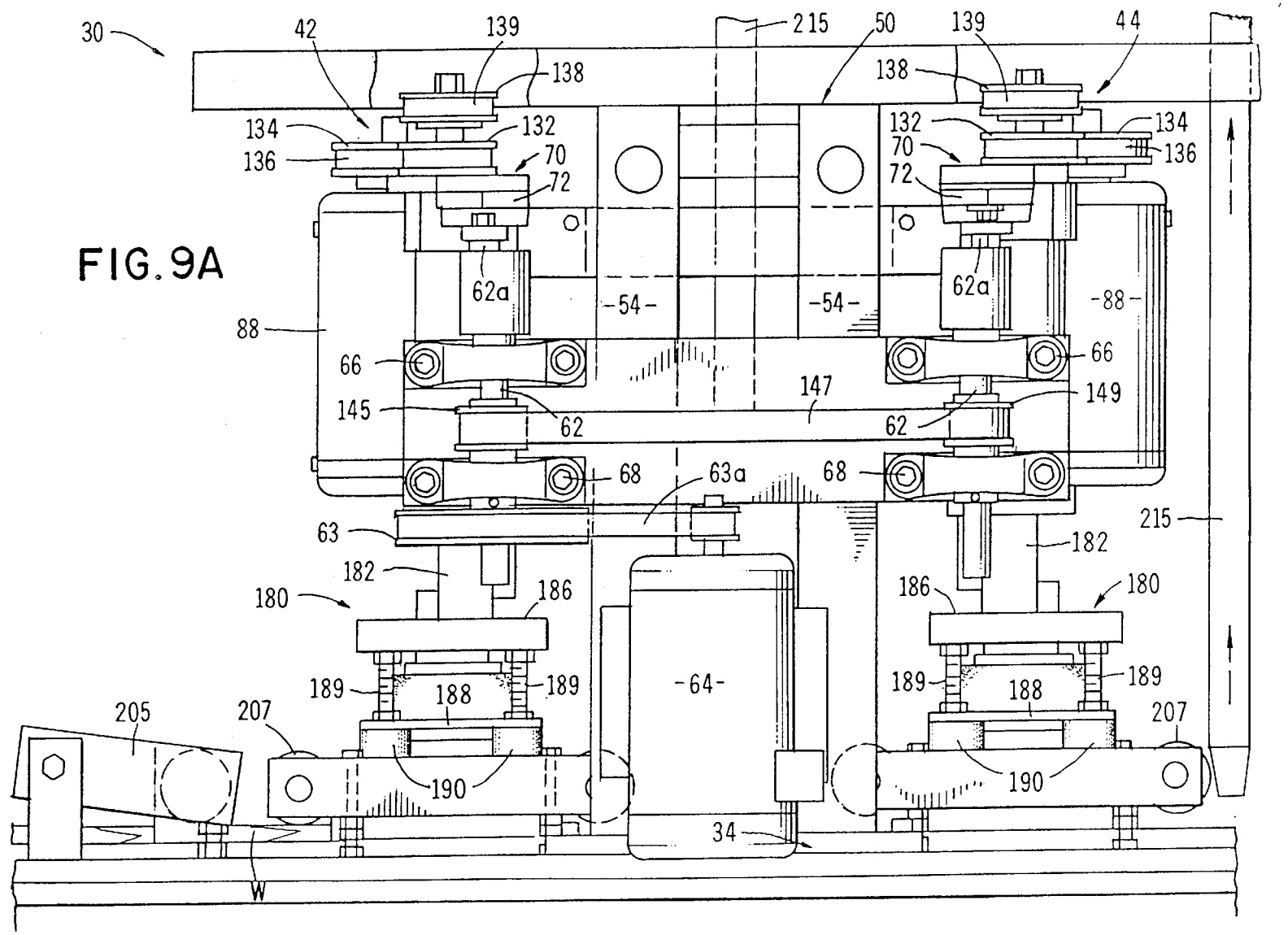
FIGS. 9A and 9B, when considered together, comprise an enlarged, side-elevational view of the apparatus of the invention taken along lines 9—9 of FIG. 6B.
Figure 9B:
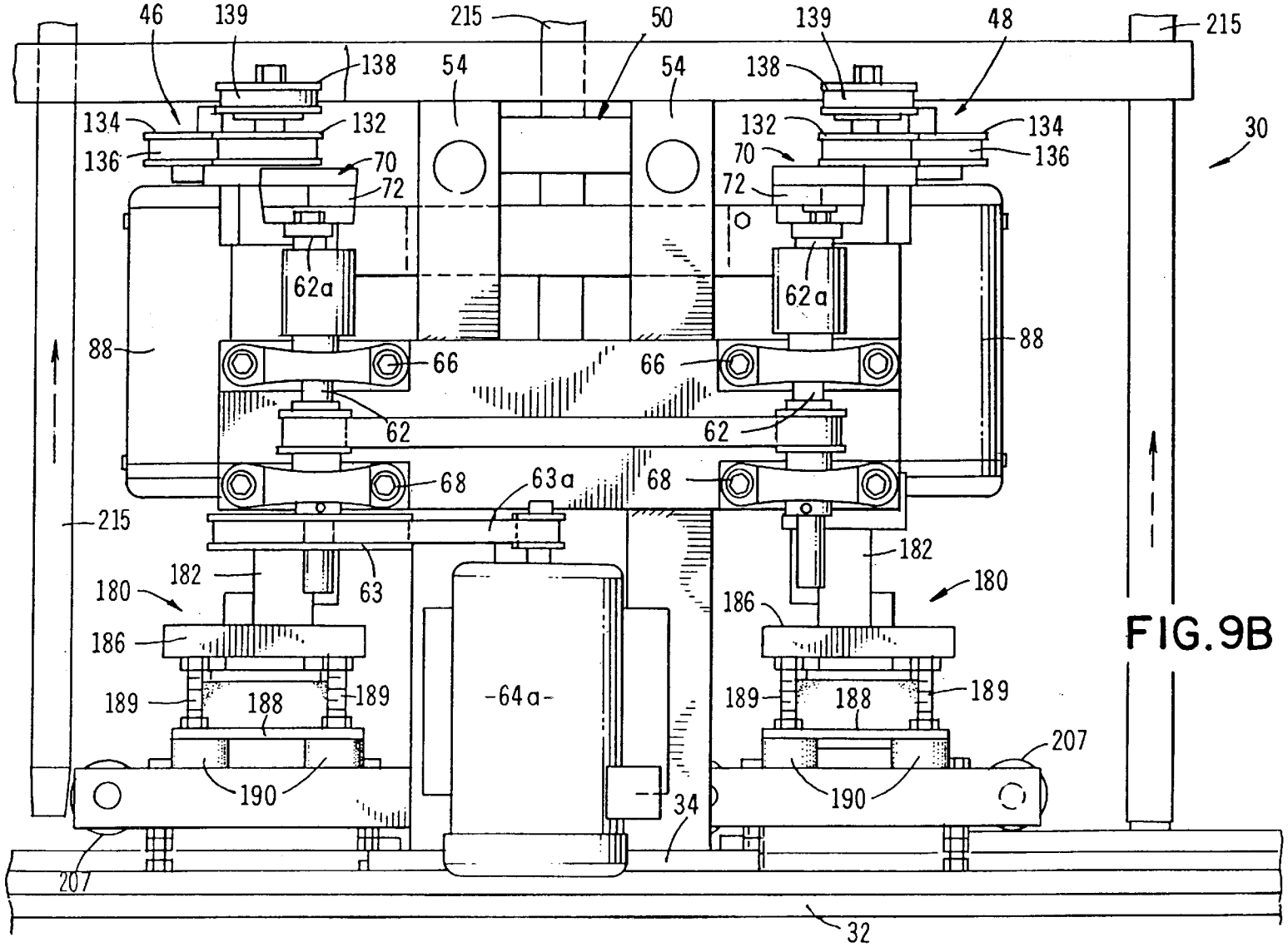
Figure 10:
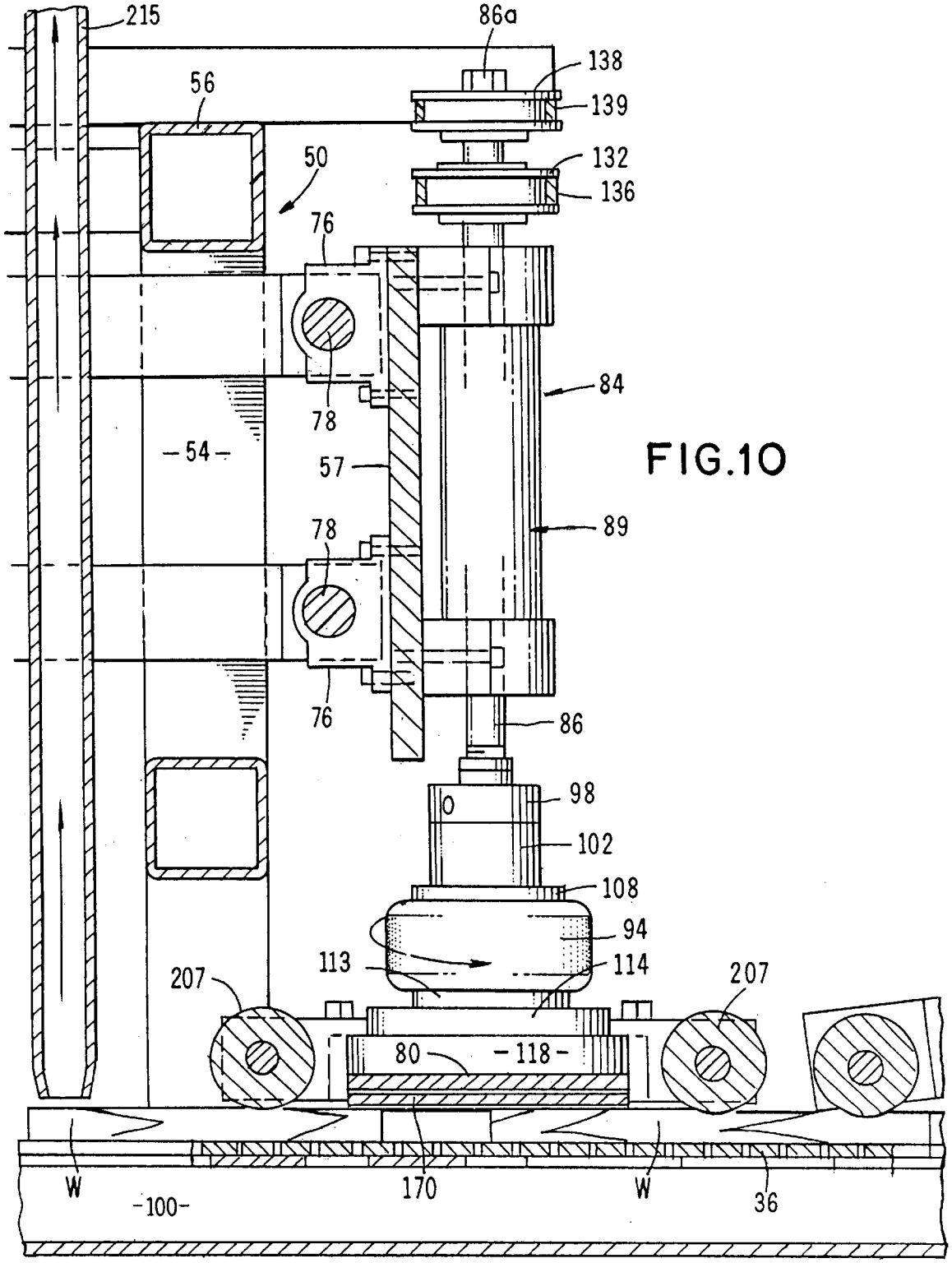
FIG. 10 is an enlarged, cross-sectional view taken along lines 10—10 of FIG. 6B.
Figure 11:
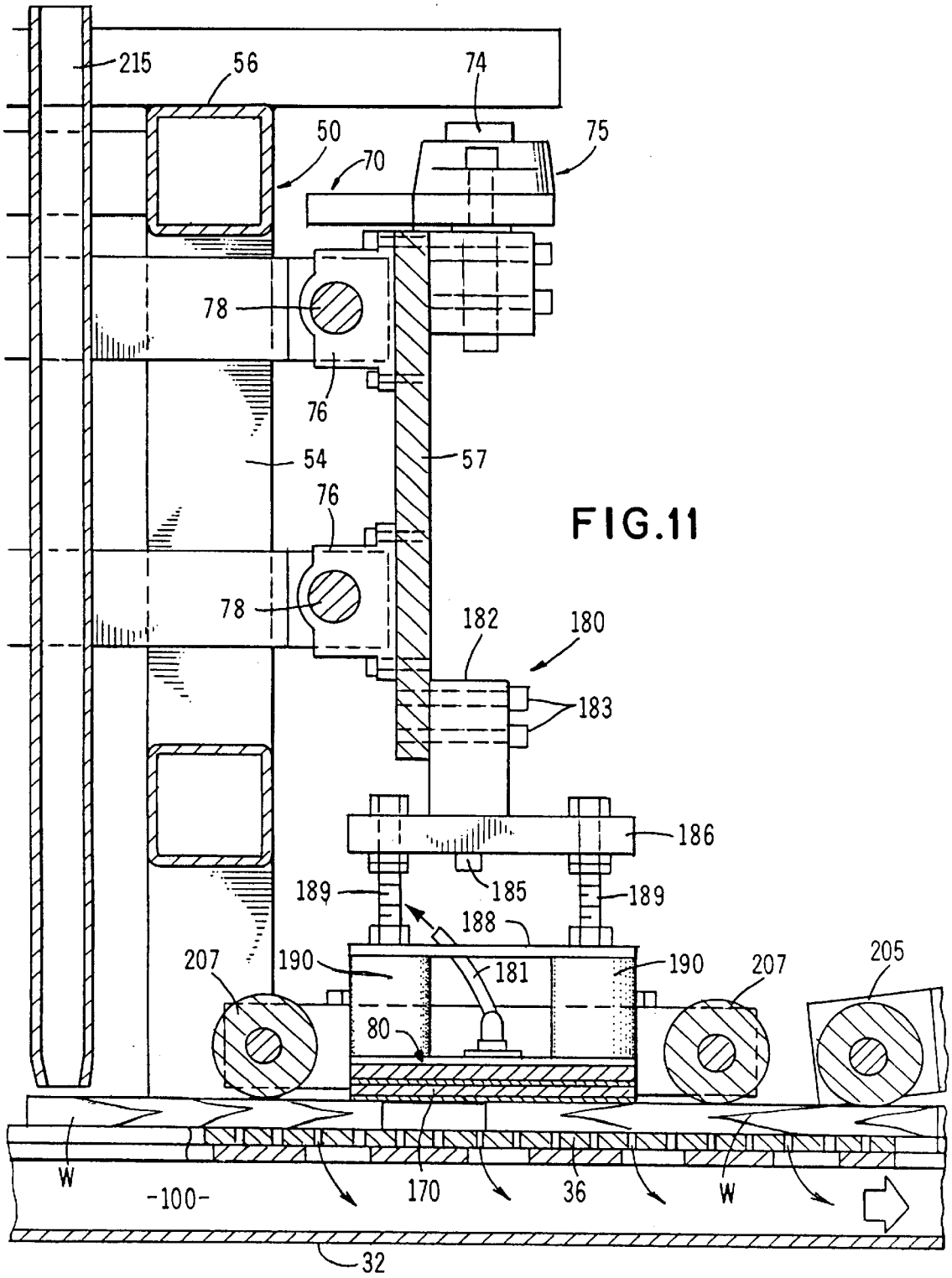
FIG. 11 is an enlarged, cross-sectional view taken along lines 11—11 of FIG. 6B.

As best seen in FIG. 1B, finishing subsystems 42 and 44 are in the back-to-back relationship. Similarly, as shown in FIG. 1A finishing systems 46 and 48 are in a back-to-back relationship (see also FIGS. 4A and 4B). With this construction, a common motor 64 of the first motion imparting means can drive the reciprocating arms 70*a* and 70*b* (FIG. 5A) to impart reciprocal motion to back-to-back platforms 57*a* and 57*b* and to the platen assemblies 80*a* and 80*b* associated therewith. More particularly, rotation of shaft 62 of subsystem 44 is accomplished by means of a sheave 145 which is connected to shaft 62 of subsystem 42 and by a drive belt 147 which interconnects sheave 145 with a sheave 149, which, in turn, is connected to shaft 62 of subsystem 44 (see also FIGS. 2B, 9A and 9B). In similar fashion, motor 64*a* (FIG. 5B) imparts reciprocal motion to both reciprocating arms 70*c* and 70*d* of finishing subsystems 46 and 48

Considering next the novel construction of platen assembly 80 of the apparatus of the invention, the assembly here comprises an upper layer, or upper structural skin 154, and a spaced-apart lower layer of structural skin 156. Disposed intermediate skins 154 and 156 is a lightweight structural foam core 156. Skins 154 and 156 are specially constructed with each being made up of at least three separate layers of thin carbon fiber sheet material 156*a*, 156*b* and 156*c* which are laid up at 90 degrees with respect to one another (see FIG. 23). It is to be understood that more than three layers can be laid up at 90 degrees if desired for certain production operations. Each of the five layers is preimpregnated with an epoxy resin and, after impregnation exhibits a thickness of approximately 0.008 inch. After lay-up of the sheet material, the structural skin assemblages thus formed heated to a temperature of between about 275 degrees and about 325 degrees Fahrenheit. While being maintained at this elevated temperature, the assembly is next placed in a press and is subjected to a pressure of on the order of 1000 pounds per square inch.

After layers 154 and 156 are suitably formed in the manner described in the preceding paragraphs, they are bonded to a very lightweight structural foam core 158. This bonding step is accomplished at a temperature of between about 65 degrees and about 90 degrees Fahrenheit using a suitable acrylic structural adhesive. During bonding the assemblage is placed in a press and placed under a pressure of approximately 500 pounds per square inch for a time period of approximately two hours.

The carbon fiber material used in the formation of skin 154 and 156 is readily commercially available from sources such as Newport Adhesives of Newport Beach, Calif. Similarly, the structural foam used to construct core 158 is readily commercially available from sources such a Composite Structures Technology of Tehachapi, Calif. The acrylic structural adhesive used to bond layers 154 and 156 to core 150 is readily commercially available from sources such as Click Bond, Inc. of Carson City, Nev.

The platen assembly 80, which is constructed in a manner described in the preceding paragraph is very light weight, yet extremely rugged and durable in operation. Because of its extreme lightweight and durability, the orbit generating means of the invention will impart a uniform and highly effective orbital motion to the platen as the orbit-generating mechanisms operate in the manner previously described.

Figures 17A, 19, 23:
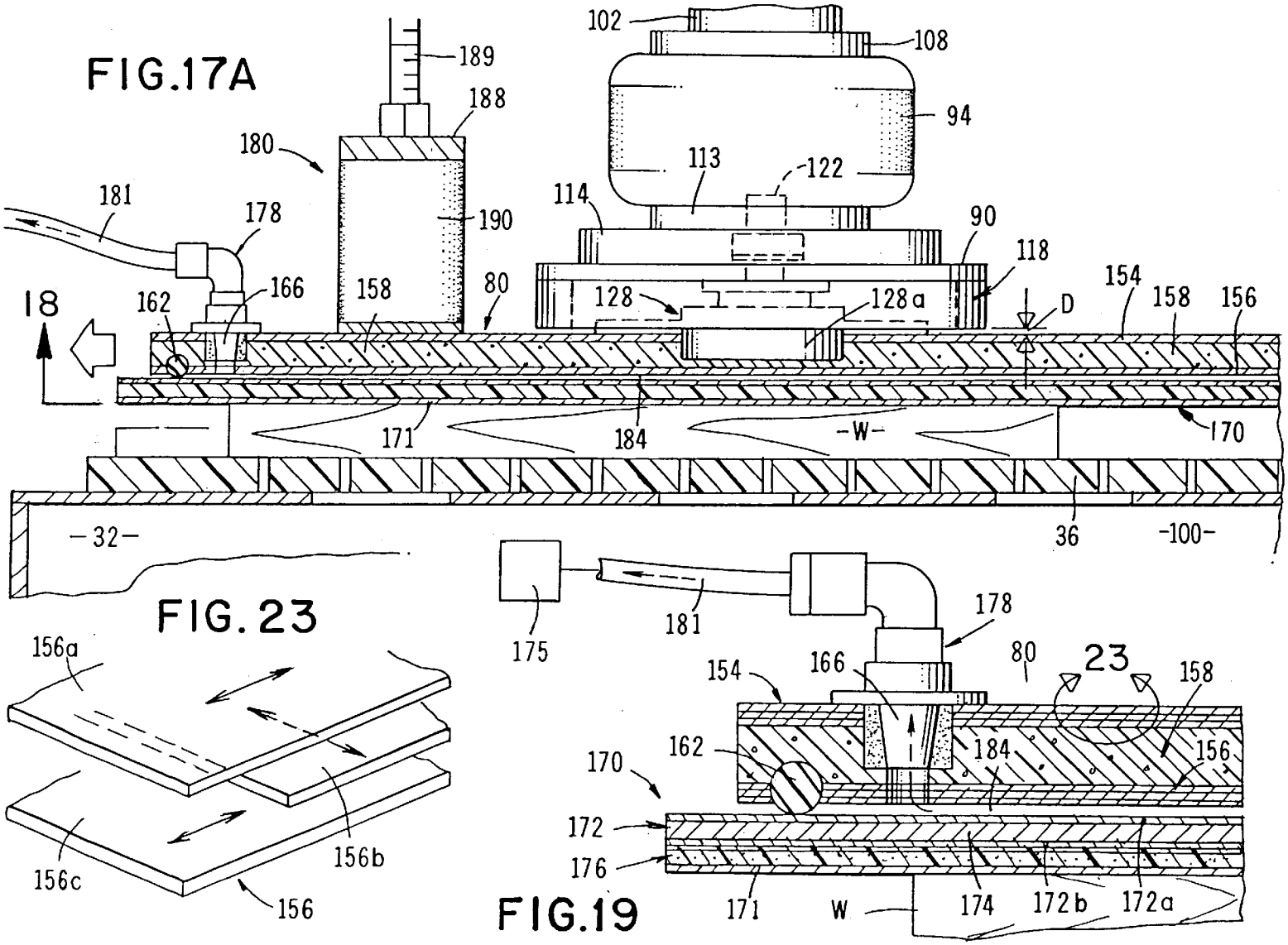
FIGS. 17A and 17B comprise an enlarged, cross-sectional view taken along lines 17—17 of FIG. 12.
FIG. 19 is an enlarged, fragmentary side-elevational, cross-sectional view of a portion of one of the platen assemblies of the apparatus of the invention.
FIG. 23 is a greatly enlarged fragmentary view of the area designated in FIG. 19 as 23—23.
Figure 17B:
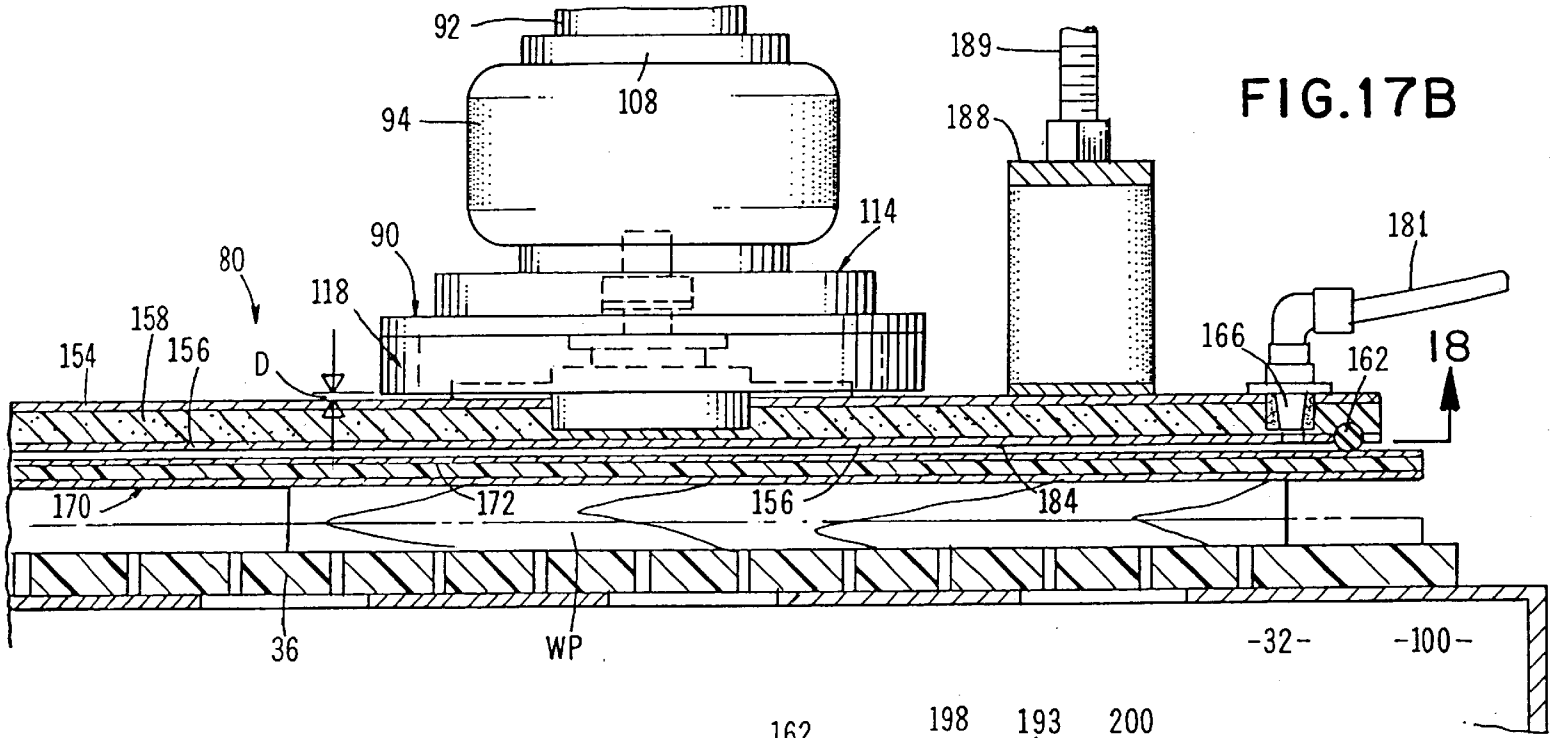
Figure 18:
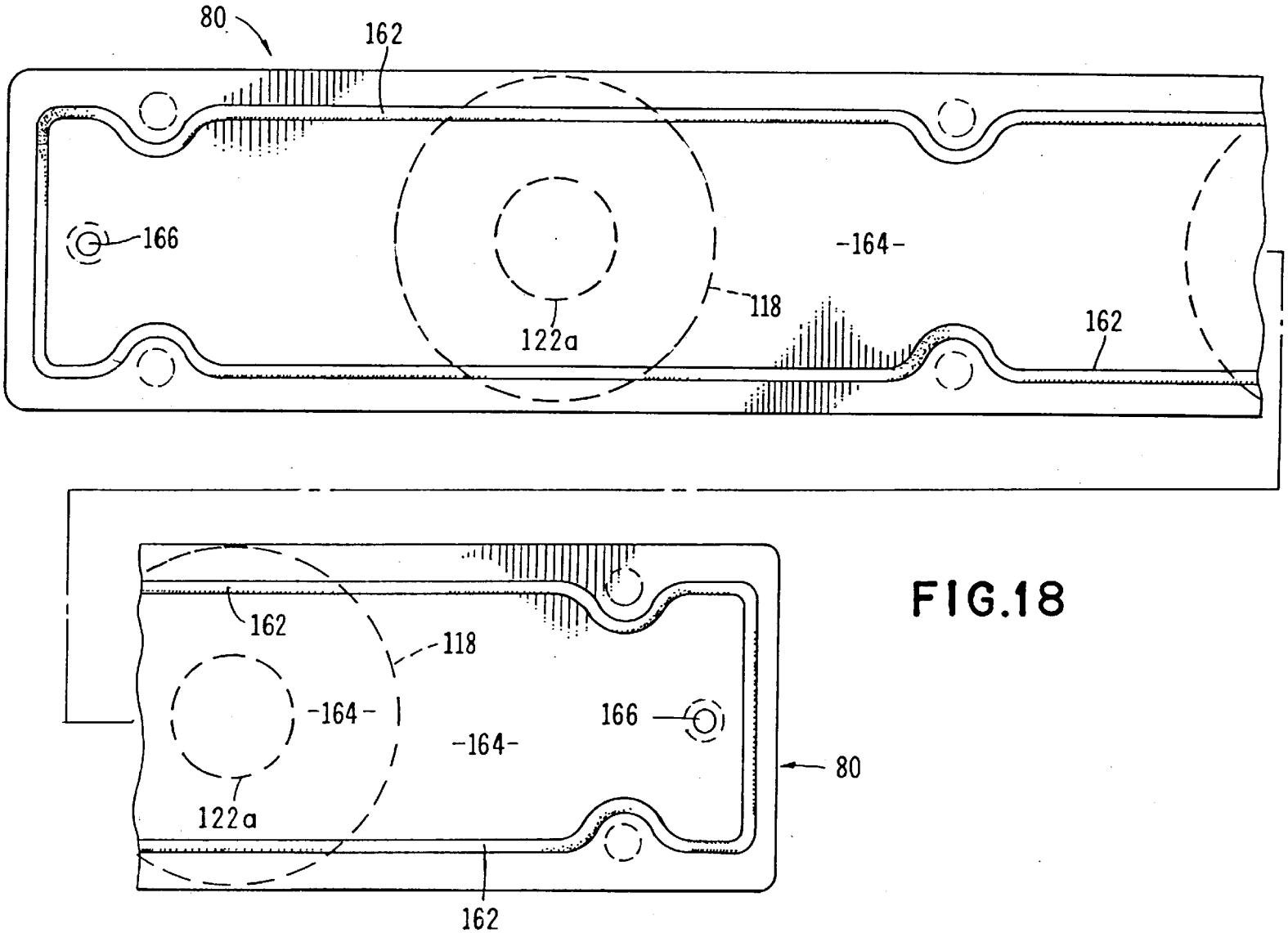
FIG. 18 comprises a view taken along lines 18—18 of FIGS. 17A and 17B.
Figure 22:
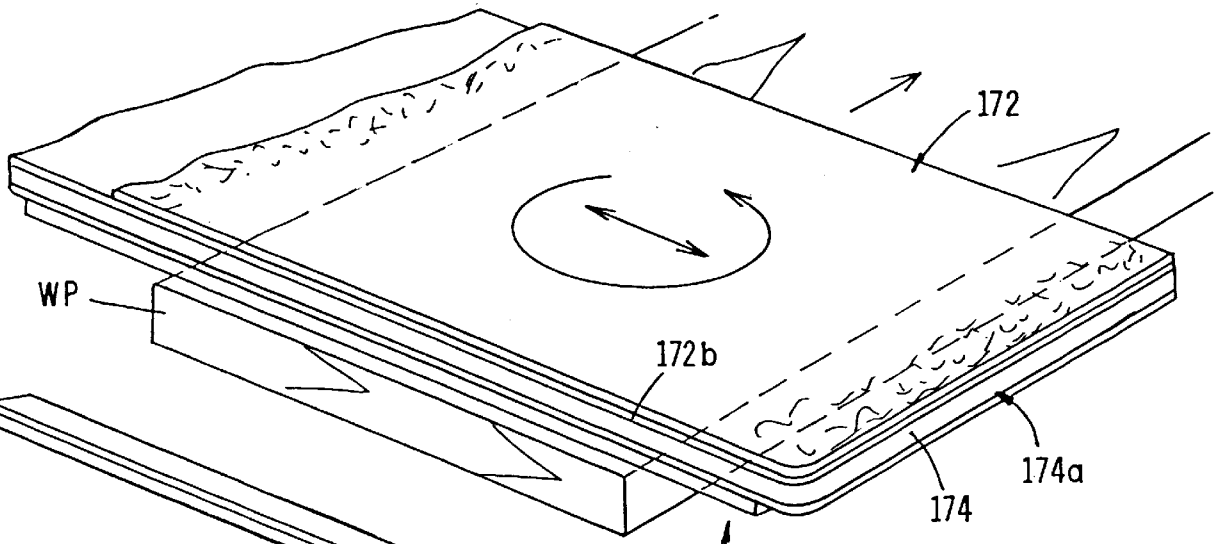
FIG. 22 is a generally perspective illustrative view illustrating the degrees of movement of the sanding platen of the invention.

As shown in FIGS. 17A, 17B, 18, and 19, an elongated elastomeric O-ring 162 is attached to the lower surface of the platen assemblage so that it circumscribes an area 164 thereof in the manner best seen in FIG. 18. A pair of bores 166 extend in through the end portions of area 164 in a manner shown in FIG. 18 (see also FIGS. 17A, 17B and 19). Interconnected with bores 166 is the important vacuum means of the invention for creating a vacuum between area 164 and a novel abrasive assembly generally designated by the numeral 170.

Figure 20:
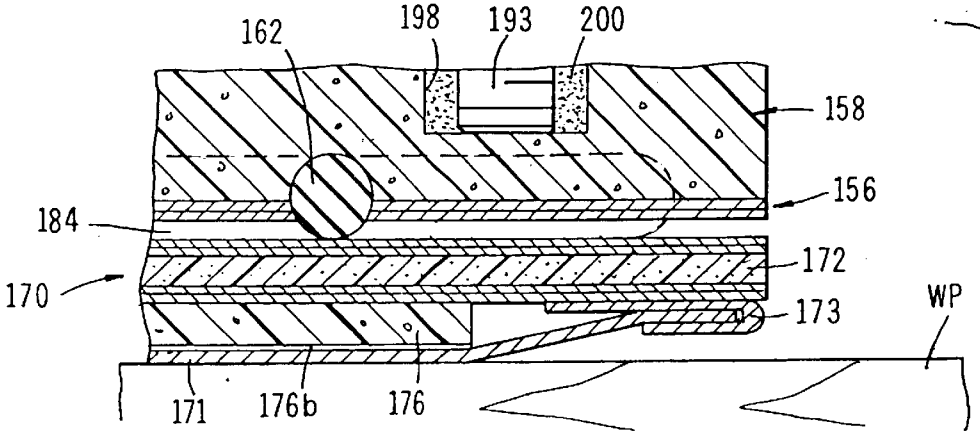
FIG. 20 is a greatly enlarged fragmentary, cross-sectional view of a portion of the platen assembly of the apparatus of the invention showing the manner in which the sandpaper is affixed to the platen.
Figure 21:
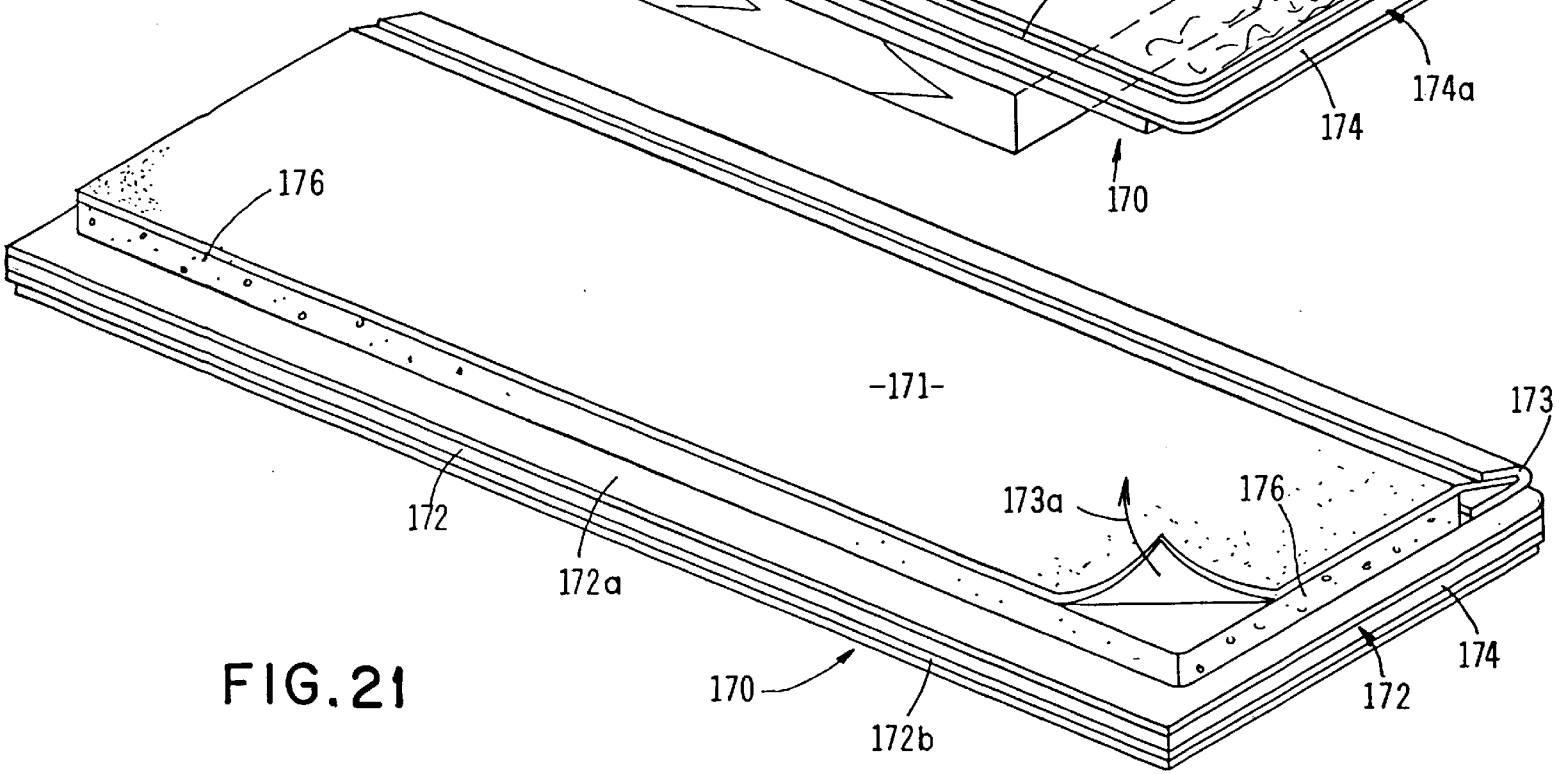
FIG. 21 s a generally perspective, fragmentary top view of a portion of one form of the platen and assemblies of the invention.

As best seen by referring to FIGS. 19 and 21, abrasive assembly 170 comprises a laminate support 172 that includes a top surface 172*a* and a bottom surface 172*b*. Disposed between surface 172*a* and 172*b* is a rigid core 174. Suitably affixed to bottom surface 172*b* of laminate support 172, as by adhesive bonding, is a yieldably deformable pad like member 176. Pad like member 176 is disposed between upper and lower surface panels 176*a* and 176*b* respectively, in the manner shown in FIG. 21. Lower surface panel 176 is adapted to support an abrasive material, shown here as a planar sheet of sandpaper 172. One edge of the sheet of sandpaper 172 is removably connected to the abrasive assembly by edge securement means here shown as a grooved member 173 (FIG. 20) and to surface 176*b* by a suitable adhesive which serves to securely interconnect the sandpaper with surface 176*b*, but at the same time permits removal thereof by a force exerted on the sandpaper in a direction of the arrow 173 of FIG. 21.

The vacuum means of the present form of the invention comprises a conventional vacuum pump 175 (FIG. 19), which is interconnected with a vacuum connector assembly 178 of the character shown in FIG. 19, which is, in turn, interconnected with pump 175 by an elongated conduit 181. With the construction thus described, when the abrasive assembly is pressed into engagement with O-ring 162 and vacuum pump 175 is energized, a vacuum will be formed between area 184 of the platen assembly and the upper surface 172*a* of support assembly 174. This vacuum will securely hold the abrasive assembly in position relative to the platen so long as vacuum pump 175 is operated.

Figure 12:
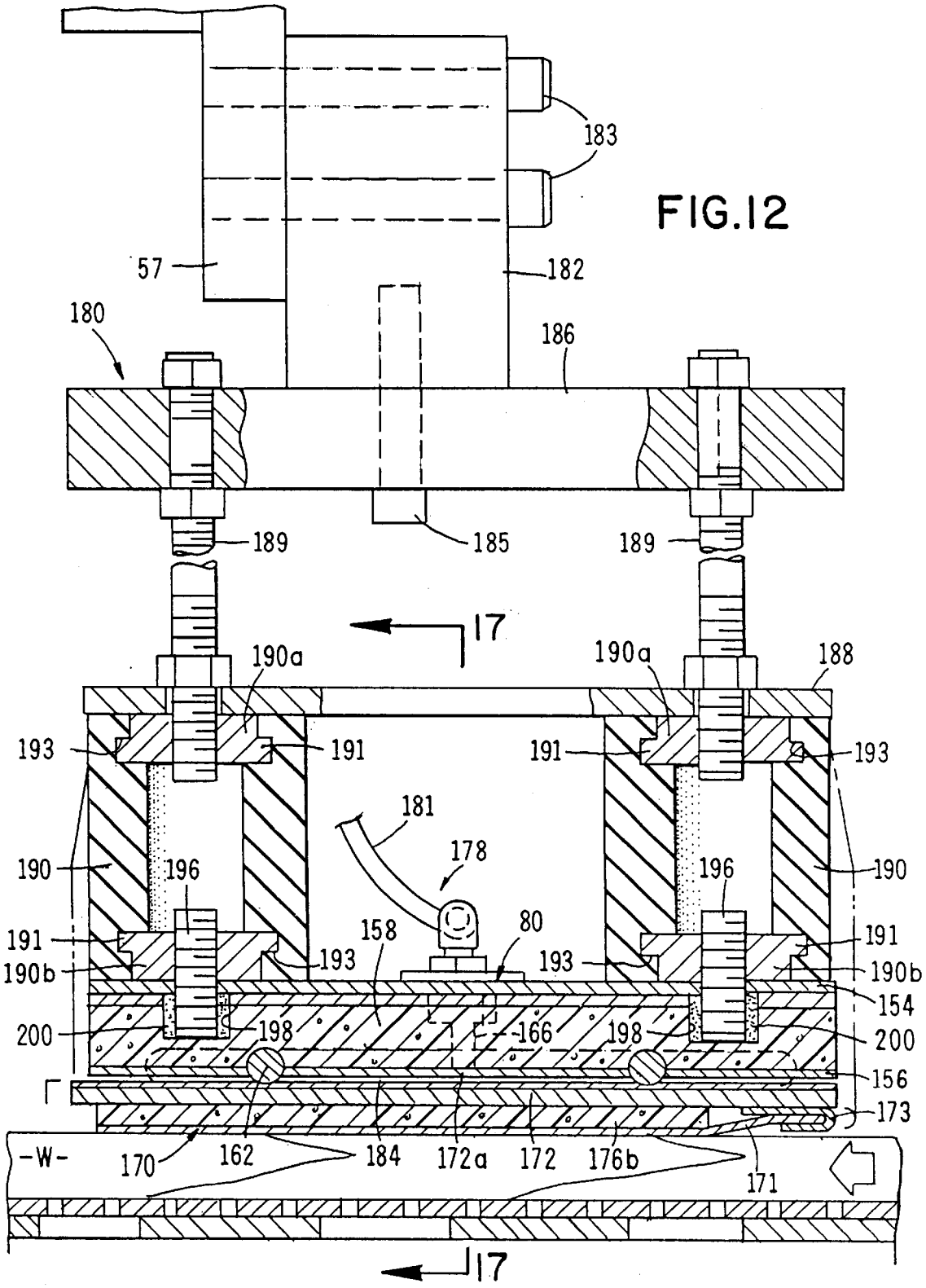
FIG. 12 is an enlarged, cross-sectional view taken along lines 12—12 of FIG. 6A.

Platen assembly 80 is interconnected with platform 57 by a plurality of A novel resilient connector means of the character best seen in FIG. 12 and there generally designated by the numeral 180. These novel, resilient connector means, each of which is of identical construction, comprise a connector block 182 which is connected to platform 57 by threaded connectors 183. Connected to block 182 by a threaded connector 185 is a generally horizontally extending plate-like member 186. Member 186 is, in turn, connected to a second plate-like support 188 by a pair of threaded connectors 189. Second support 188 is connected to platen assembly 80 by means of a pair of elastomeric sleeve like isolation members 190. Each of the isolation members 190 includes upper and lower connector members 190*a* and 190*b* respectively. Each of these connector members include a flange portion 191 which is received within upper and lower grooves 193 formed in member 190. Upper connector 190*a* is threadably interconnected with the lower end of shaft 189, which lower connector 190*b* is interconnected with platen assembly 80 by means of a threaded stub connector 196, the lower end of which is received within a counter bore 198 formed in the platen core. An acrylic adhesive 200 of the same character as used in constructing the platen assembly is poured into bore 198 so that it completely surrounds the lower end of the stub shaft and securely interconnects it with the platen core.

With the construction described in the preceding paragraph, as the platen assemblage moves in its orbital motion, elastomeric sleeve or isolation members 190, which are formed of a suitable elastomer, such as rubber or the like, stabilize platen assembly 80 during start-up and, while sanding, the workpiece. During sanding the sleeves permit limited relative movement between platform 57 and platen assembly 80. As best seen by referring to FIGS. 1A and 1B, each of the subsystems 42, 44, 46 and 48 includes four identical resilient connector means of the character just described. It is apparent that these novel resilient connector means function to support platen assembly 80 in a resiliently movable relationship with respect to platforms 57 of each of the subsystems 42, 44, 46, and 48 of the apparatus.

Figure 3:
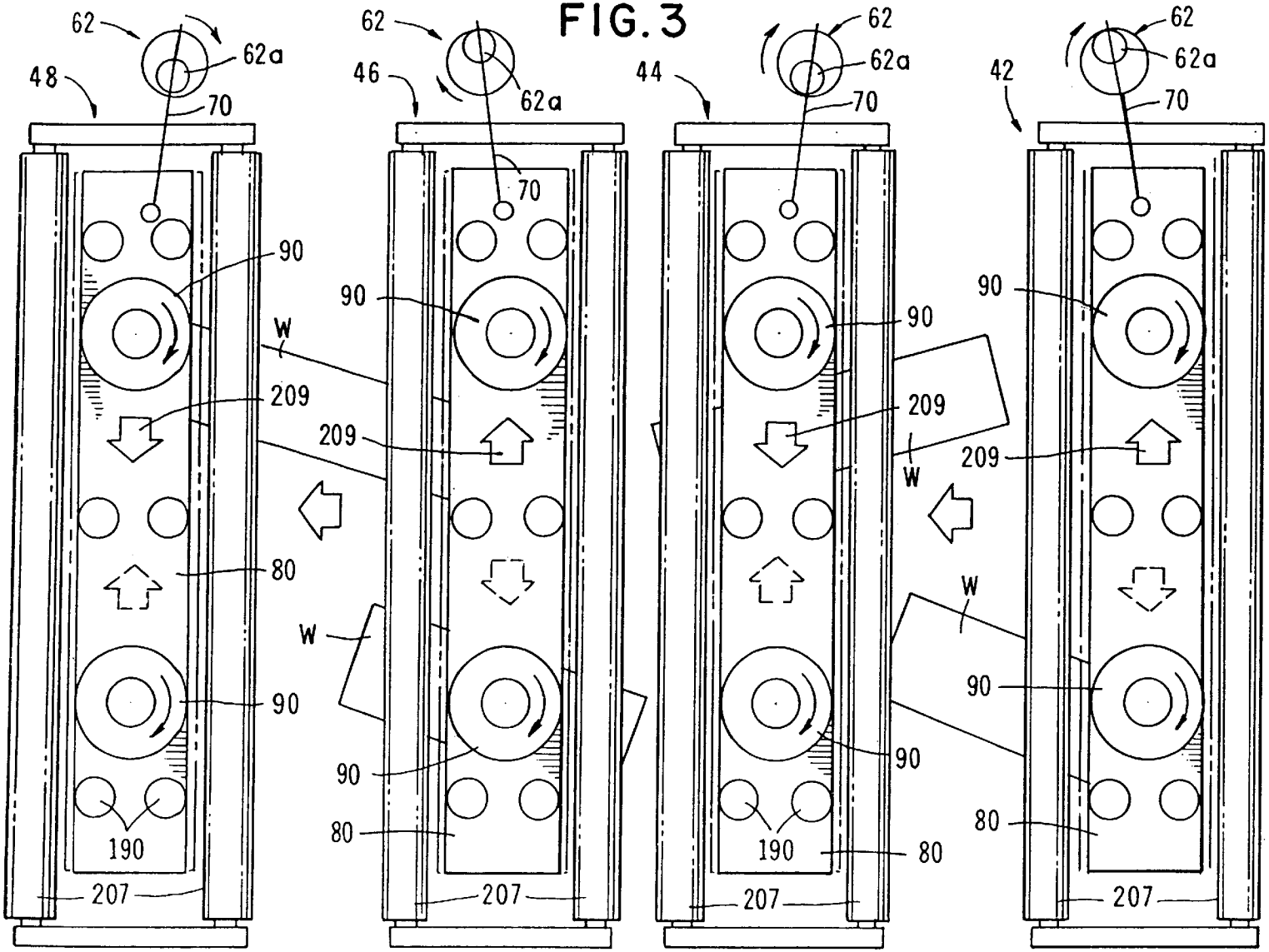
FIG. 3 is a generally diagrammatic, top plan view of the four surface finishing subassemblies of the apparatus of the invention illustrating the direction of movement of the platens of the subsystems.
Figure 16:
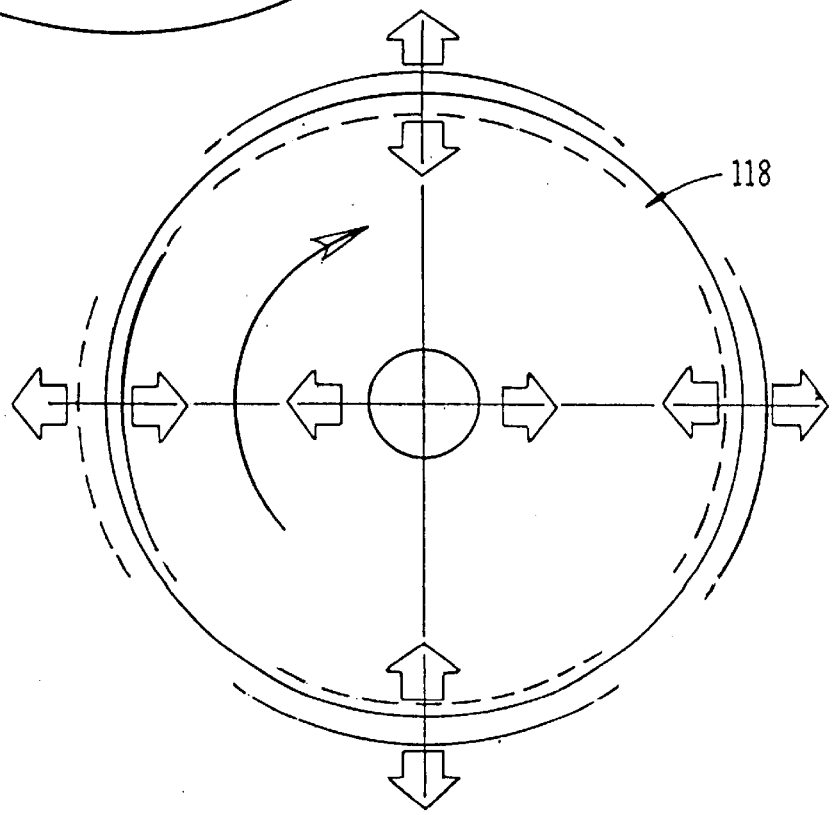
FIG. 16 is a generally diagrammatic top plan view illustrating the vibratory movement produced as a result of rotation of the apertured ring shown in FIG. 15.

In operating the apparatus of the invention, the workpiece "W", which may be, by way of example, a cabinet door, is placed on the apertured conveyor in the manner shown in FIG. 1B. A vacuum is drawn by a conveyor vacuum means 100 to urge the workpiece securely against the upper surface of the conveyor belt 36. As the workpiece moves forwardly, it passes under a limit switch assembly 205 which gauges its thickness. If the workpiece has a thickness greater than can be safely accommodated by the platen assemblies, the conveyor will automatically stop. In this regard, during the surface preparing operations, each of the platens of the sanding subsystems roll along the workpiece via sets of work engaging rollers 207 provided on the platens. When the work piece clears the limit switch assembly and moves toward the first finishing station, the motors of the first and second motion-imparting means are suitably energized. This causes the first motion-imparting means to reciprocate the platen assemblies in the manner indicated by the arrows 209 in FIG. 3. As the platen assemblies are reciprocating, the second motion-imparting means causes shafts 86 to be rotated at a relatively high speed which, in turn, rotates rings 118. Because rings 118 are apertured in the manner shown in FIG. 15, they will create a high frequency, generally circular orbital-like motion (FIG. 16) which will be imparted directly to the platens via the elastomeric annular shaped members 94. As shown in FIGS. 1A, 4A, 10 and 11, vacuum ducts 215 span each finishing station at a location adjacent each sanding platen and function to capture and appropriately exhaust the saw dust formed during the finishing operations.

As previously mentioned, the platens are connected to the support platform 57 of the apparatus by the elastomeric sleeves or isolation members 190, thereby allowing the platen to float along the workpiece. The amplitude of the orbital motion caused by the second motion imparting means, varies depending on the configuration of the rings 118 and the speed of rotation of shafts 86. This simultaneous reciprocal and orbital motion of the sanding platen assemblies 80 produces a very fine surface on the workpiece which is markedly superior to the surfaces produced using traditional mechanisms.

Figure 24A:
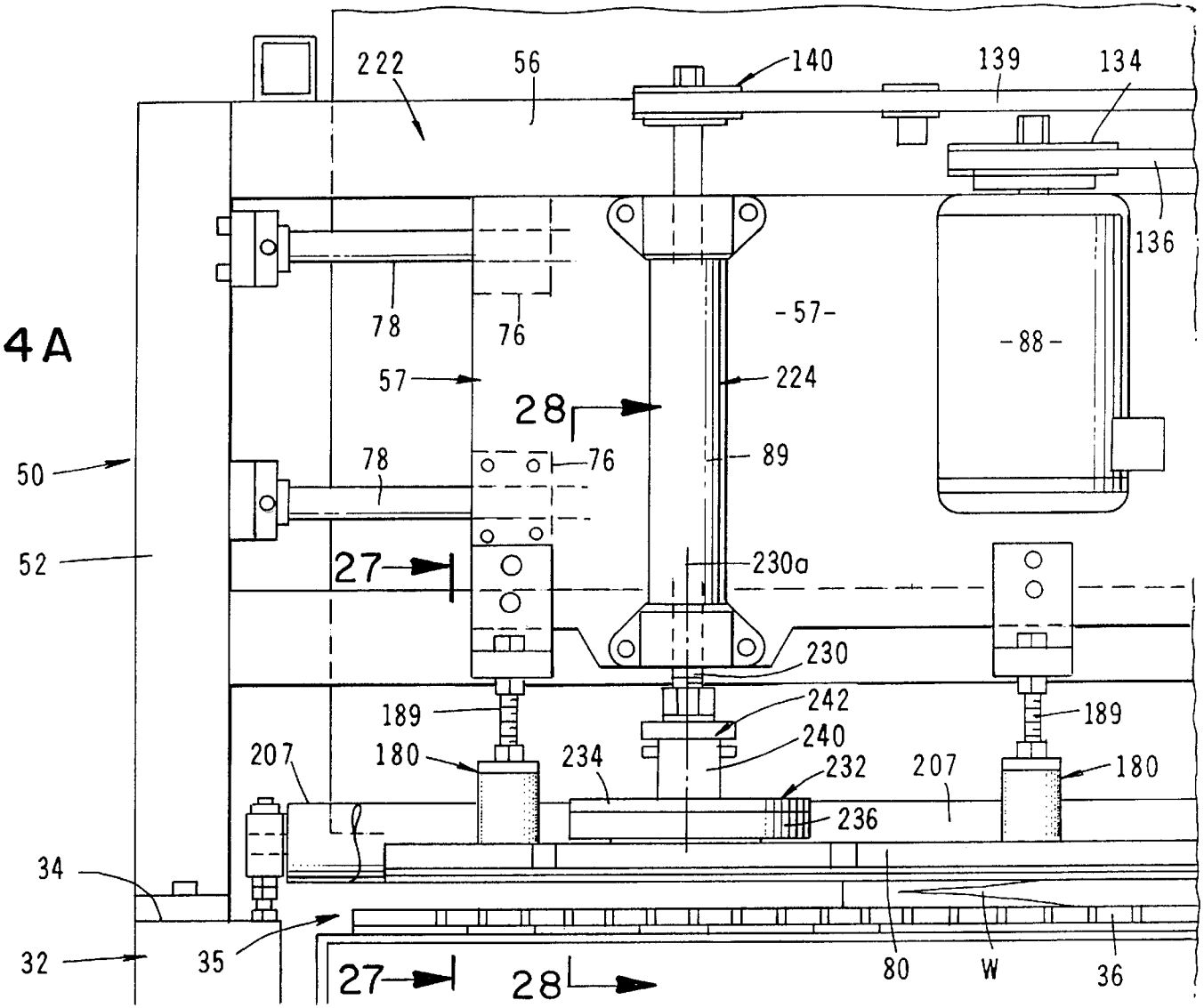
FIGS. 24A and 24B when considered together, comprise a view similar to FIGS. 6A and 6B showing an alternate form of the apparatus of the invention.
Figure 24B:
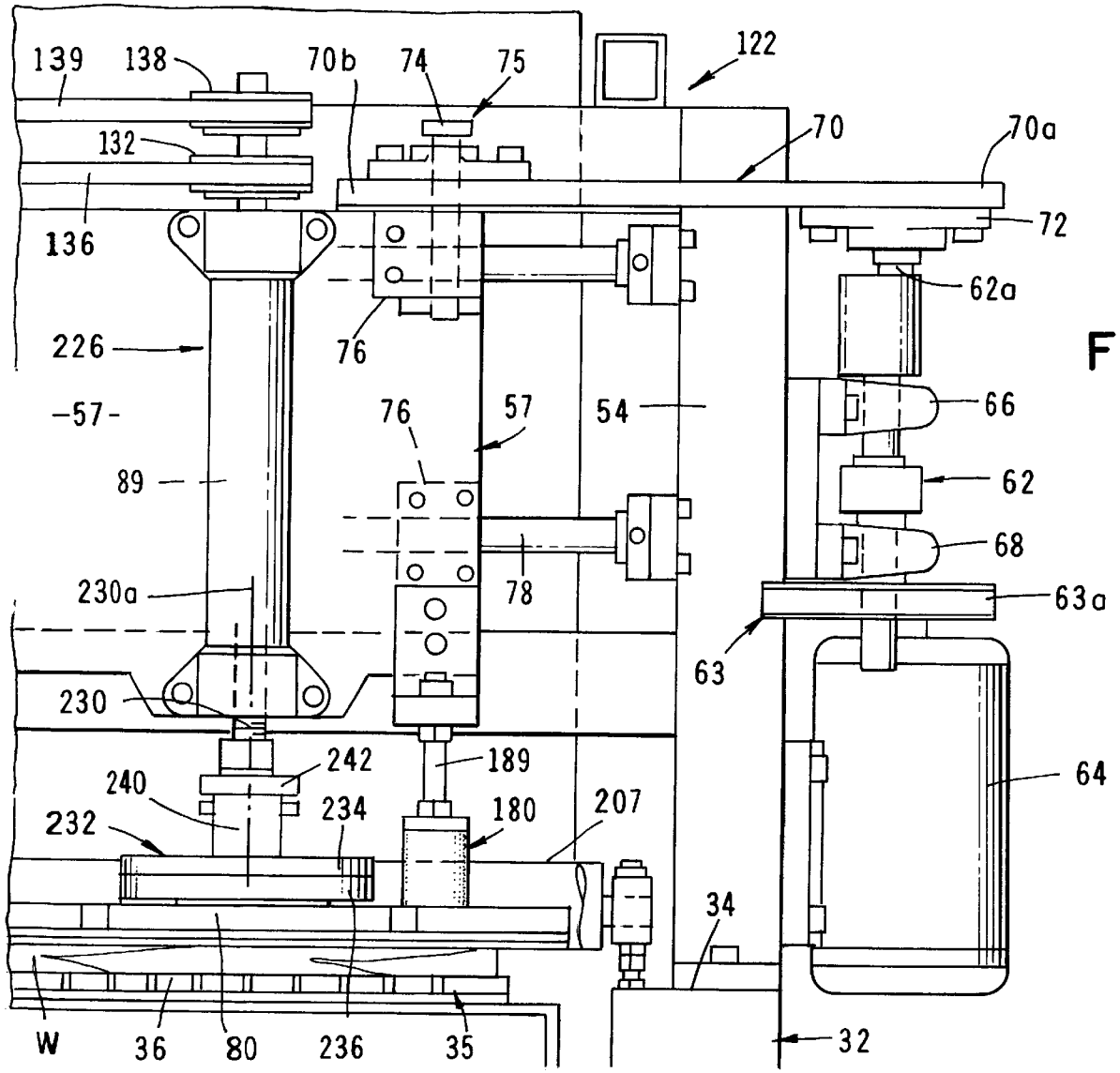
Figure 25:
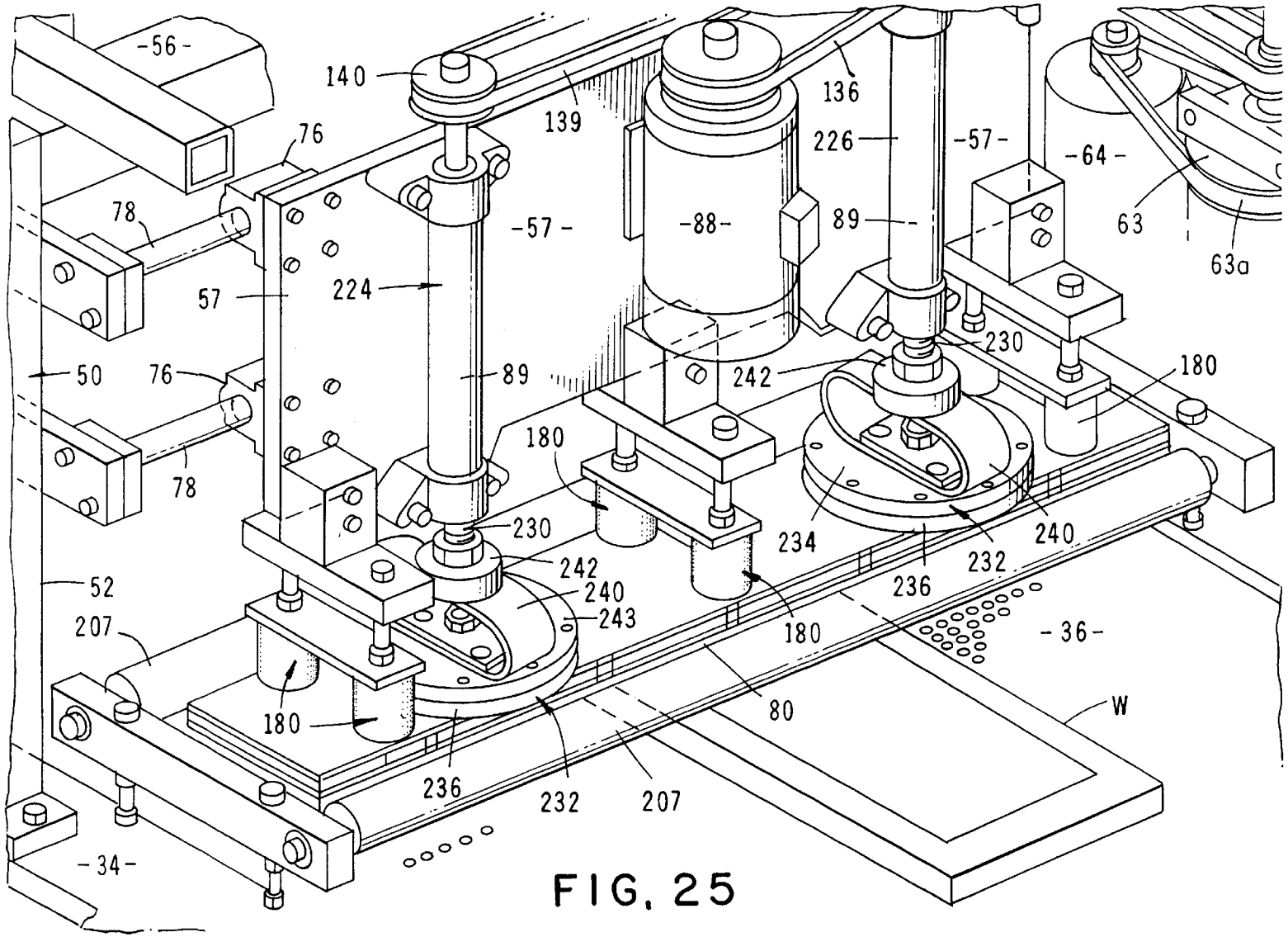
FIG. 25 is a generally perspective, fragmentary view of a portion of the alternate form of the apparatus shown in FIGS. 24A and 24B showing an alternate type of interface means.

Referring next to FIGS. 24A, 24B and 25 an alternate form of the invention is there shown. This alternate form is similar in many respects to that shown in FIGS. 1 through 23 and like numbers are used in FIGS. 24 through 29 to identify like components. The primary difference between this latest embodiment of the invention and that earlier described resides in the provision of a slightly different type of vibratory motion imparting means, the character of which will presently be described.

As shown in FIGS. 24A and 24B, the apparatus here comprises a stationary main frame 32 of the character previously described having transversely space-apart, generally horizontally extending mounting surfaces 34 (FIG. 2A). Connected to main frame 32 is a vacuum type conveyer subsystem 35 which functions in the same manner as earlier discussed and includes a perforated endless conveyer belt 36. As before, belt 36 functions to transport the workpieces "W" (FIG. 25) through the machine at a uniform rate.

The surface preparing apparatus itself of this latest form of the invention also includes four longitudinally spaced finishing subsystems , each of which is of substantially identical construction. This being the case, the description of the construction of the first finishing subsystem shown in FIGS. 24A, 24B and 25 and generally designated by the numeral 222 should be construed as also describing the remaining identical three subsystems that are not shown in these FIG. drawings.

As before, finishing subsystem 222 is supported by a fixed subframe 50, which is mounted on mainframe 32. Subframe 50 includes oppositely disposed, transversely spaced, generally vertically extending support columns 52 and 54 which are connected to the previously identified mounting surfaces 34. Subframe 50 also includes a generally horizontally extending support beam 56 which spans columns 52 and 54.

Subframe 50 supports a first motion-imparting means or reciprocating means, which imparts a transverse reciprocating movement to a transversely extending support platform 57 to which a platen assembly is connected. As in the earlier described embodiment, the first motion-imparting means includes a crank shaft 62 which is controllably rotated by an electric motor 64 within spaced-apart bearings 66 and 68 which are connected to subframe 50 in the manner best seen in 24B. Motor 64 drives shaft 62 via a driven sheave 63 which is connected to shaft 62 and to a drive belt 63*a* (FIG. 24B). Interconnecting shaft 62 with platform 57 is connector member shown here as an arm 70 having first and second ends 70*a*and 70*b*. First end 70*a* is connected to the upper, radially off-set end 62*a* of shaft 62 by a bearing 72, while end 70*b* is connected to platform 57 by a shaft 74 and bearing assembly 75.

Connected to platform 57 are four spaced-apart bearing assemblies 76 which are adapted, in the manner previously described, to slide along a pair of spaced apart guide rods 78 which span subframe 50. With this construction, reciprocal movement of platform 57, along with a novel platen assembly 80, which is connected to platform 57, is accomplished by the first motion imparting means of the character described.

Figure 26A:
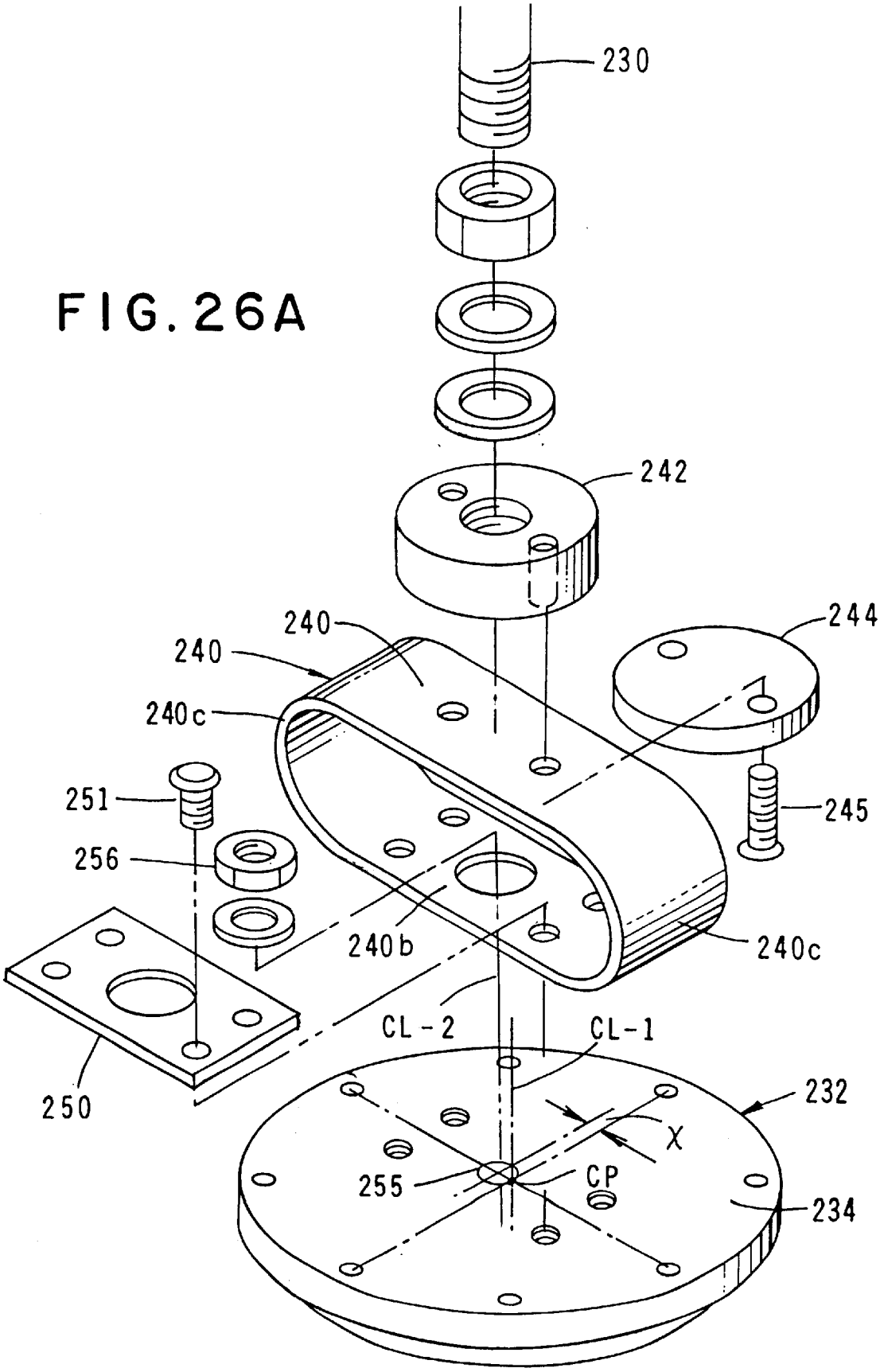
FIGS. 26A and 26B when considered together comprise a generally perspective, exploded view of the alternate form of the vibratory motion imparting means of the apparatus of the invention.
Figure 26B:
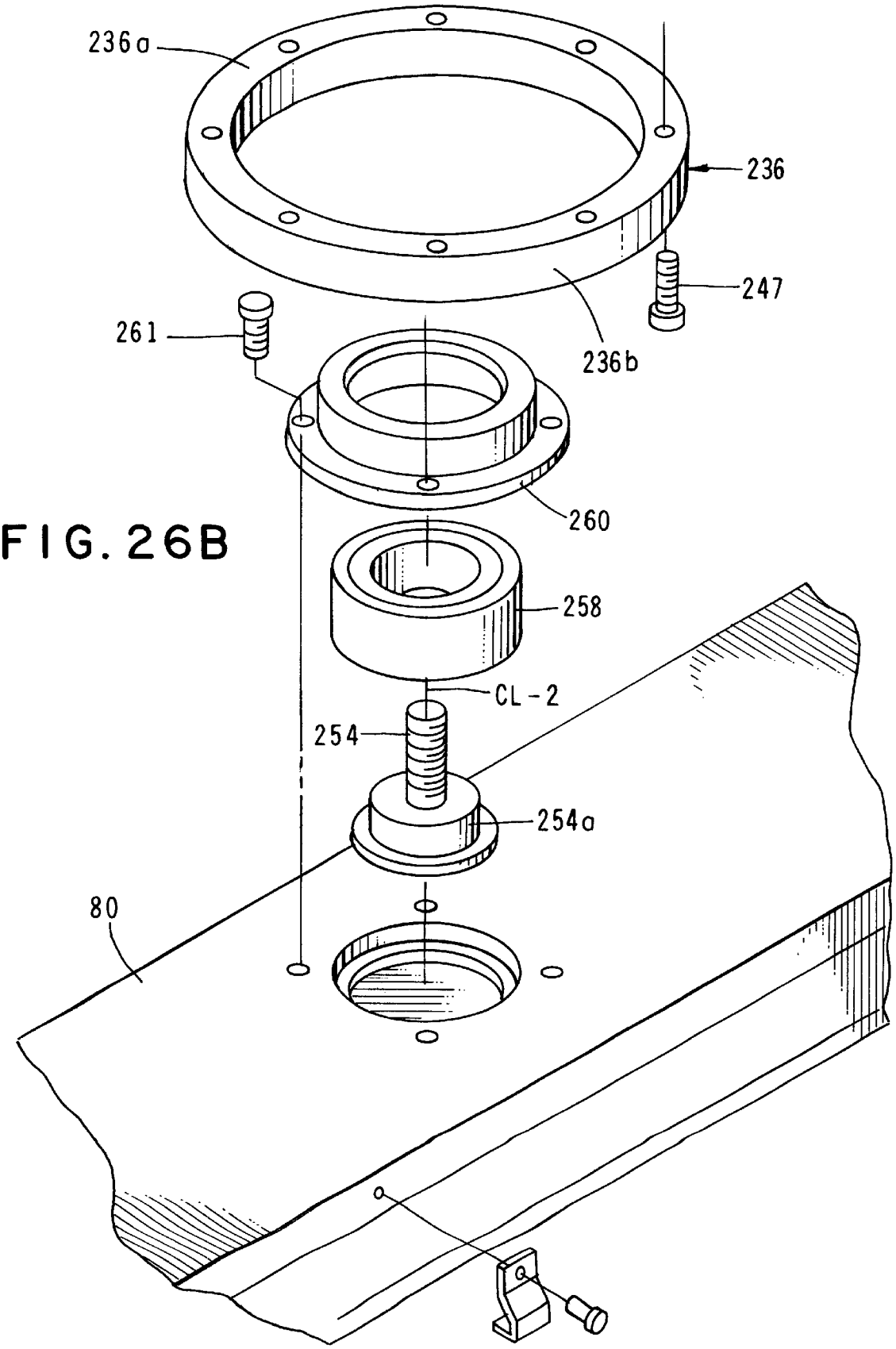
Figure 27:
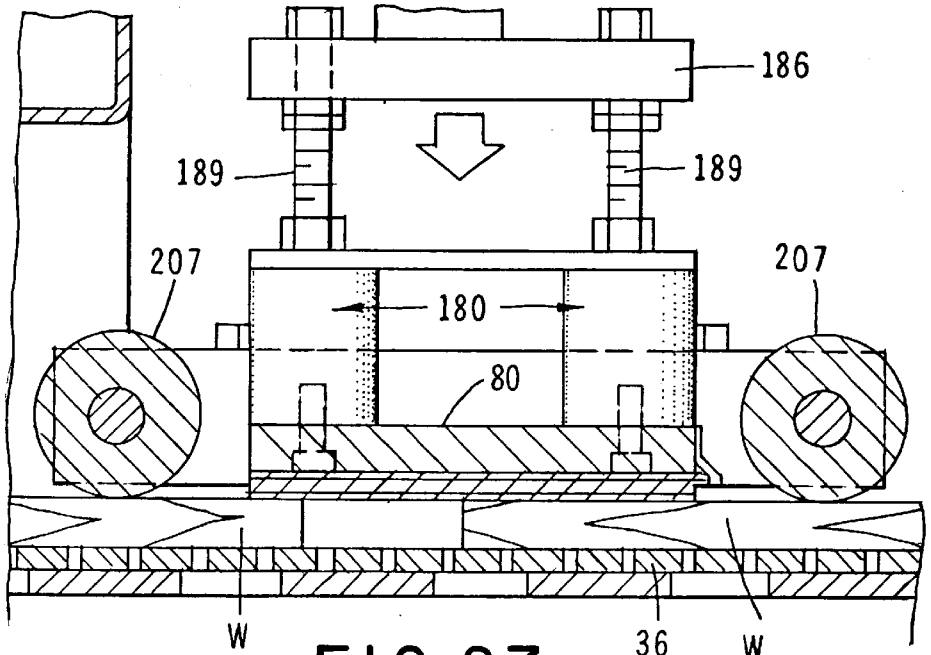
FIG. 27 is an enlarged, cross-sectional view taken along lines 27—27 of FIG. 24A.
Figure 28:
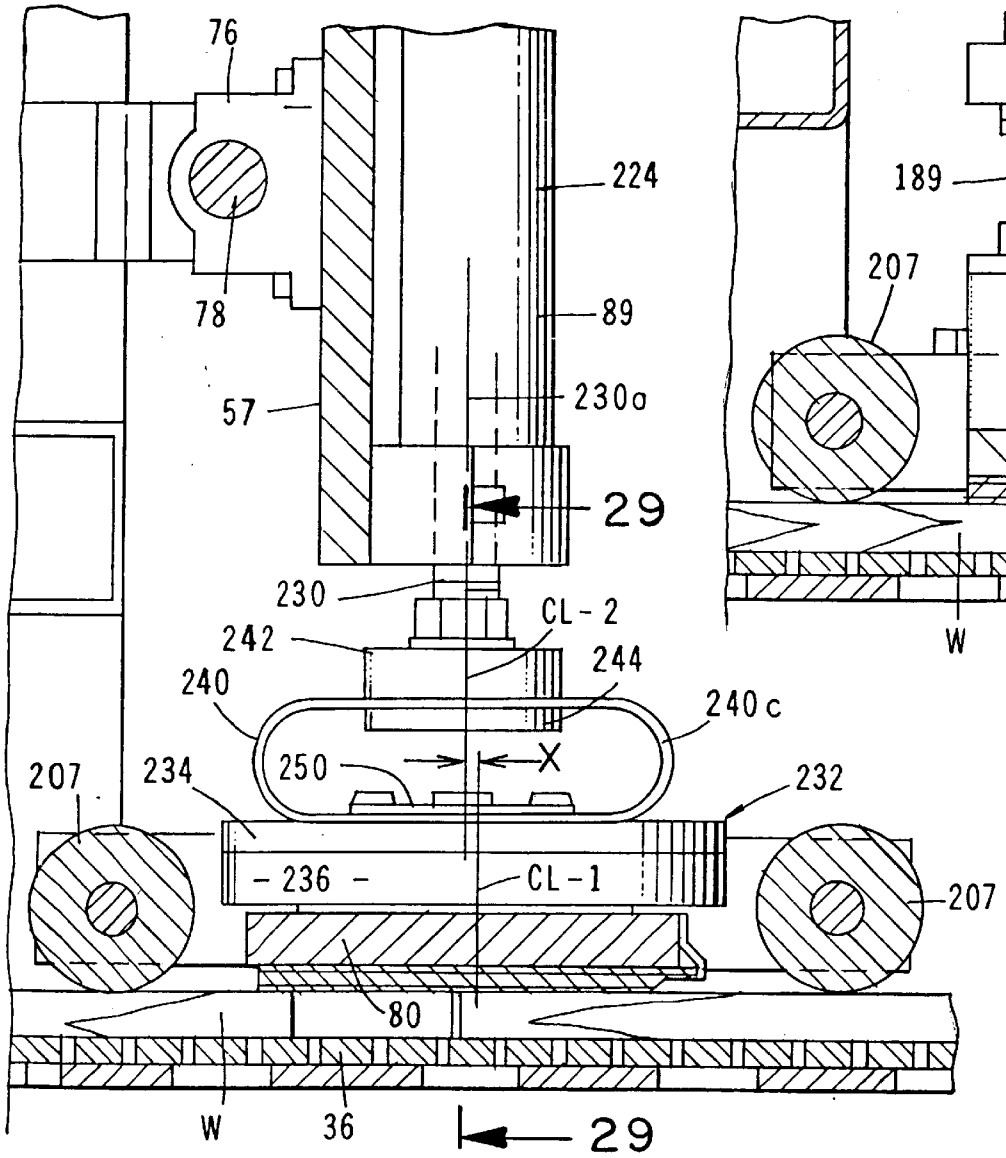
FIG. 28 is an enlarged, cross-sectional view taken along lines 28—28 of FIG. 24A.
Figure 29:
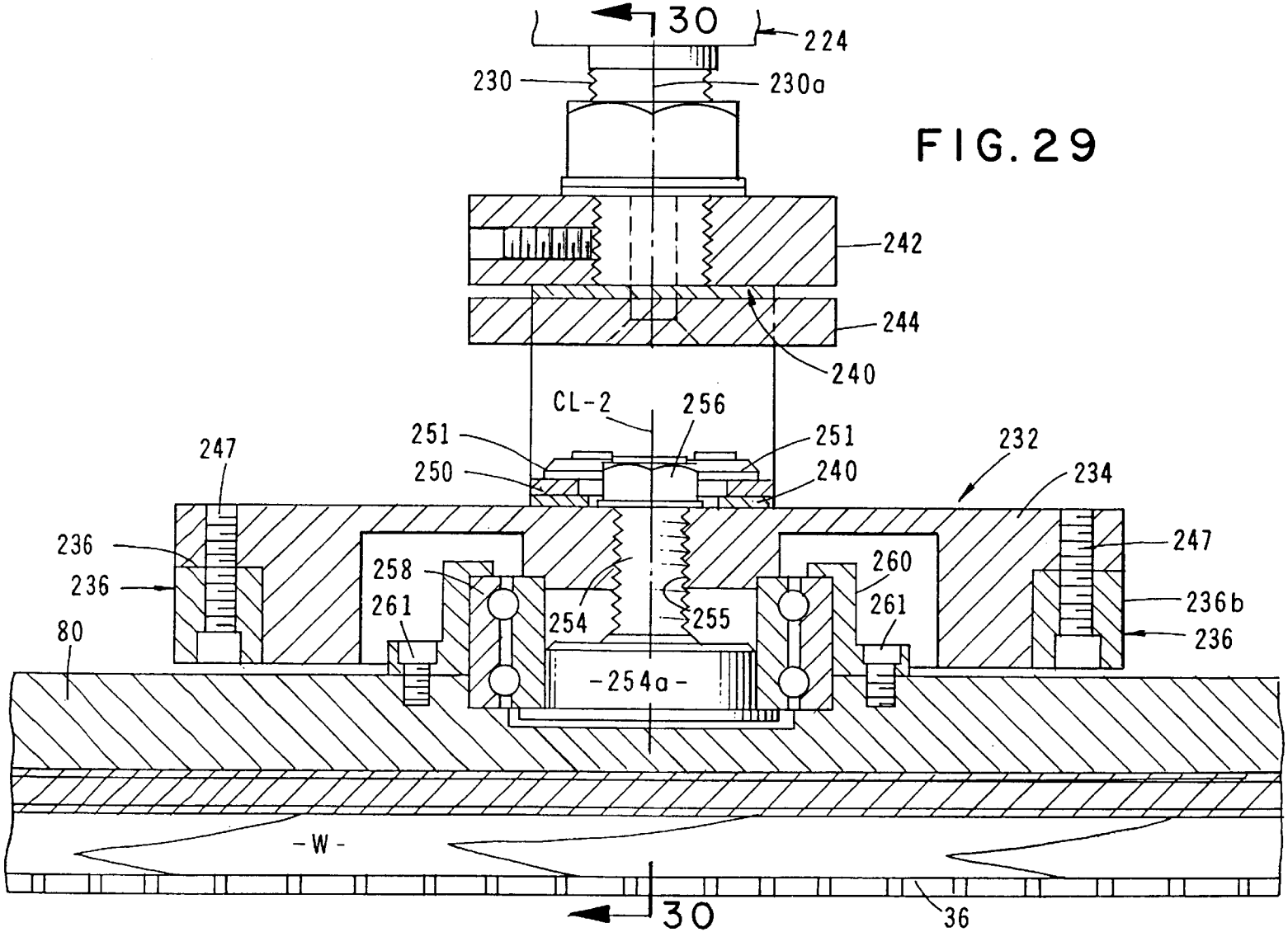
FIG. 29 is an enlarged, cross-sectional view taken along lines 29—29 of FIG. 28.

Also connected to platform 57, is the important second motion-imparting means, of this latest form of the invention for moving the platen assembly in an orbital-like motion. As before this second motion-imparting means comprises orbit generators, here identified as 224 and 226, which are similar to the previously described orbit generators 82 and 84. Each of the orbit generators 224 and 226 comprise a rotating shaft 230 and novel interface means for interconnecting shaft 230 with a ring assembly 232. Ring assembly 232 here includes a base plate 234 (FIG. 26A) and a ring 236 having peripheral portions 236*a* and 236*b* (FIG. 26B).

Figure 30:
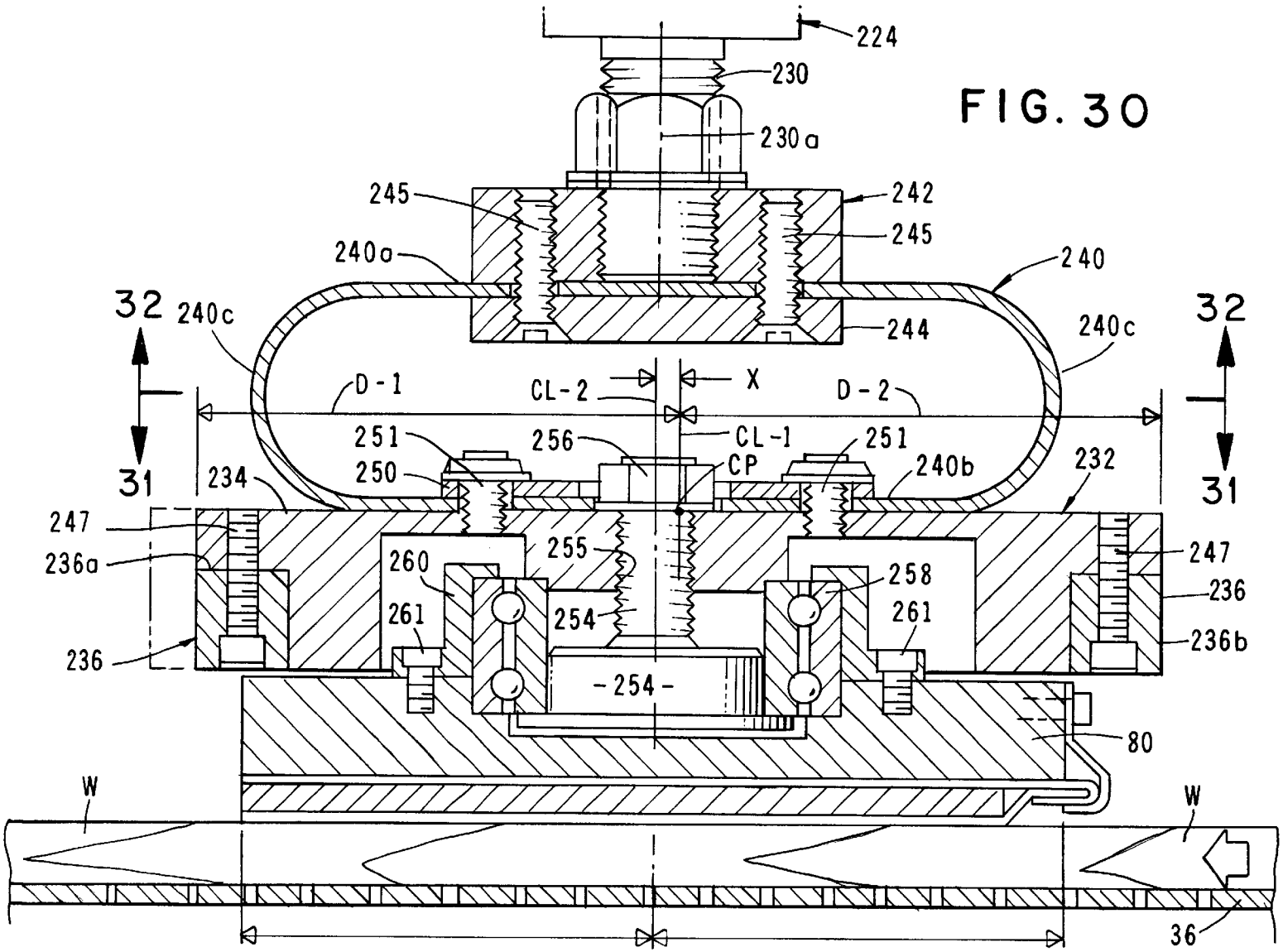
FIG. 30 is a cross-sectional view taken along lines 30—30 of FIG. 29.

The novel interface means of this latest form of the invention, rather than comprising shaped, hollow sleeve-like elastomeric members 94, here comprises a novel flexible connector band 240, which is disposed between rotating shaft 230 and plate 234 in a manner best seen in FIG. 24. As best seen in FIG. 26A, connector band 240 comprises a yieldable deformable, endless belt-like member that is connected with shaft 230 by a first connector means and is interconnected with plate 234 by a second connector means. As indicated in FIG. 26A, connector member 240 has a top wall 240*a*, a bottom wall 240*b* and curved sidewalls 240*c* that are connected with walls 240*a* and 240*b*. The first connector means here comprises a connector ring 242 that is threadably connected to shaft 230 and a connector disk 244 that is connected to ring 242 and also to the top wall 240*a* of connector band 240 by means of threaded connectors 245 (FIG. 30). As indicated in FIG. 30, connector ring 236 is connected to base plate 234 by means of threaded connectors 247.

The second connector means of the invention, which functions to interconnect connector band 240 with base plate 234, here comprises a generally rectangular connector plate 250 which is interconnected with connector band 240 and with base plate 234 by means of threaded connectors 251 (FIG. 30).

Operably associated with ring 236 and also forming a part of the second motion-imparting means of the invention, is a third connector means for operably interconnecting ring assembly 232 with platen assembly 80. This third connector means comprises a threaded stub shaft 254 which is threadably received within a threaded bore 255 formed in mounting plate 234. A locking nut 256 is threadably connected to the top of shaft 254 in the manner best seen in FIG. 30. As also indicated in FIG. 30, stub shaft 254 is provided proximate its lower extremity with a generally cylindrically shaped head portion 254*a*. Head portion 254*a* is journaled within a bearing 258 which, in turn, is mounted within a housing 260 that is connected to platen assembly 80 by threaded connectors 261.

Figure 31:
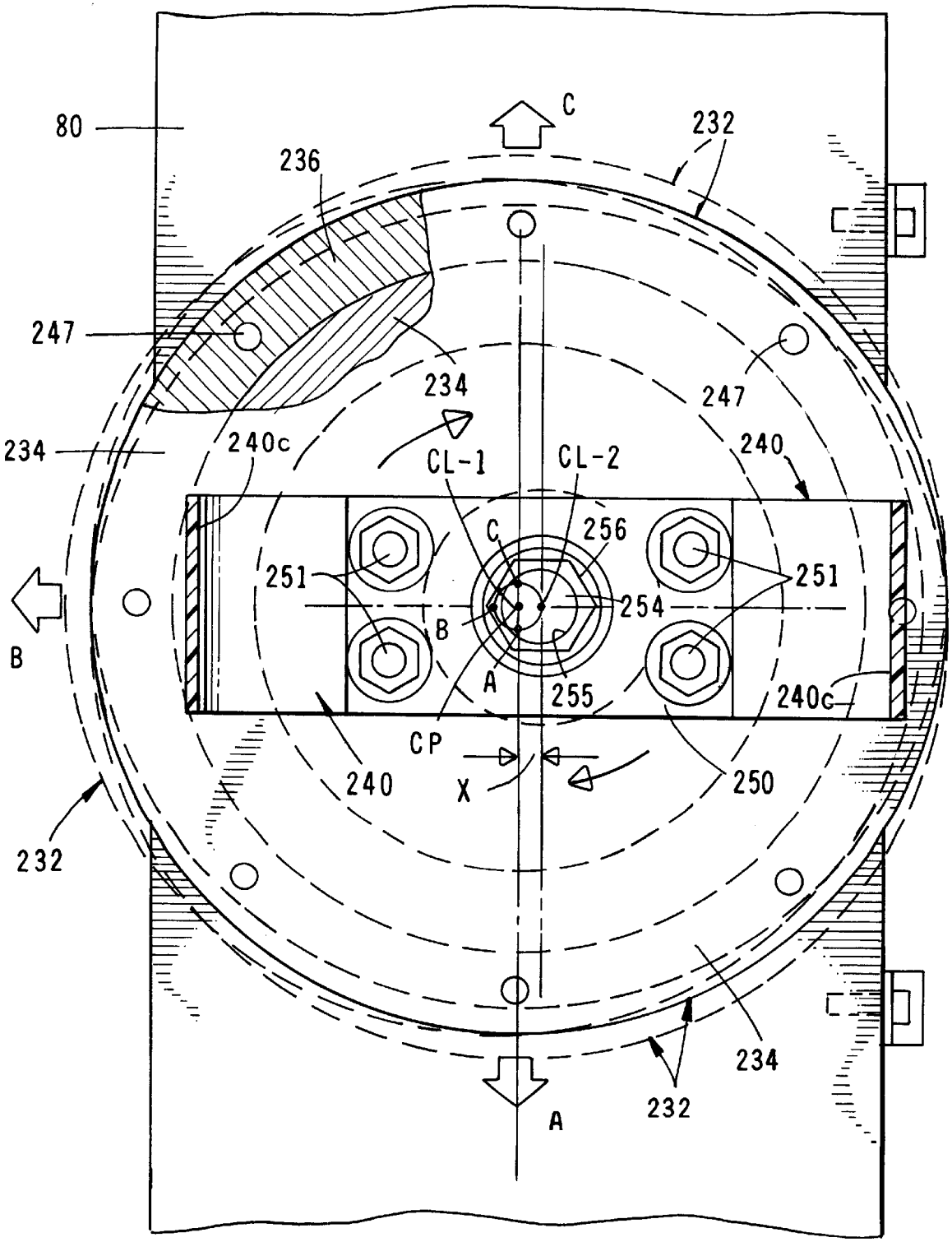
FIG. 31 is a cross-sectional view taken along lines 31—31 of FIG. 30.
Figure 32:
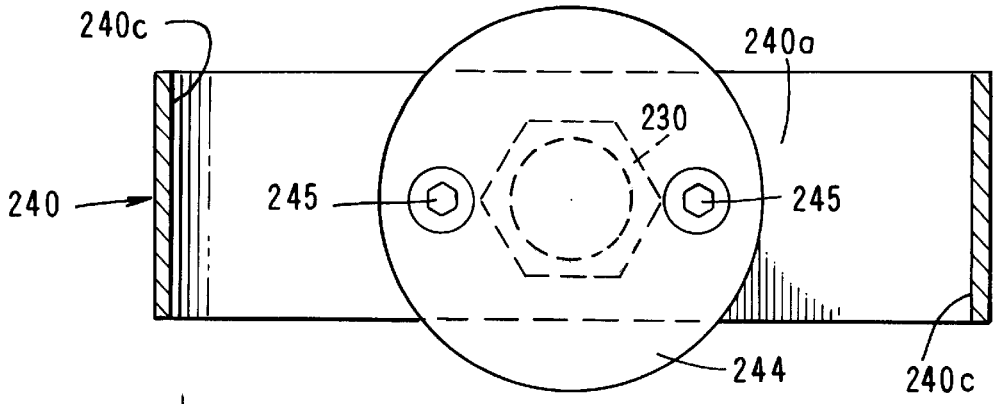
FIG. 32 is a cross-sectional view taken along lines 32—32 of FIG. 30.
Figure 33:
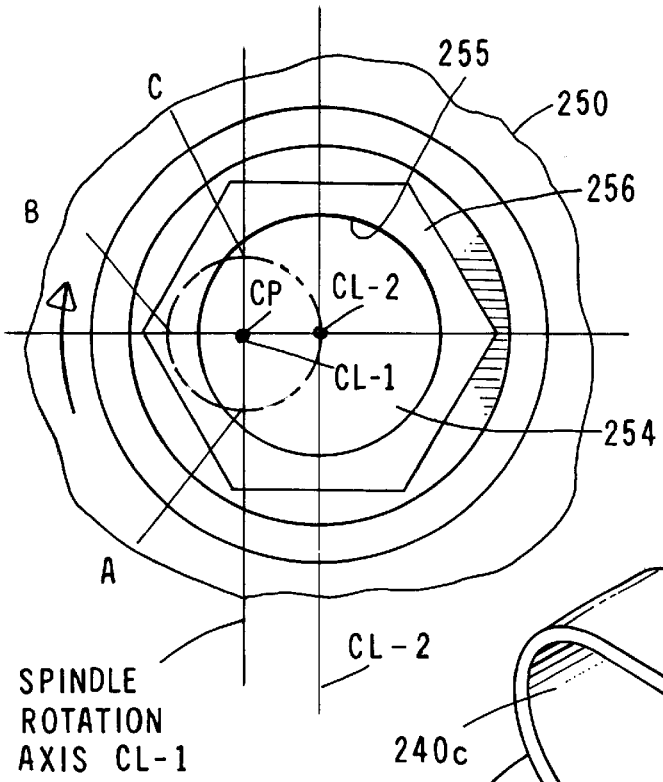
FIG. 33 is a generally diagrammatic, fragmentary top view illustrating the offset of the spindle rotation axis in the apparatus of one form of the invention.

It is very important to note that, as shown in FIGS. 26A and 31, while ring assembly 232 has an axial center line CL-1 that passes through a center point "CP", the axial center line CL-2 of the threaded bore 255 formed in base plate 234 is off set from the center point by a distance "X". Stated another way, threaded bore 255 formed in base plate 234 is not coaxially aligned with center "CP" of the base plate, but rather is offset therefrom by the distance "X" (FIG. 30). More particularly, as shown in FIG. 30, distances D-1 and D-2 are equal, but the center line 230*a* of shaft 230 is off set in the manner depicted. Distance "X" can be between about 1/16 inch and 1/4 inch, but an offset of about 3/16 inch is preferred.

With the construction described in the preceding paragraph, rotation of shaft 230 about its axis 230*a* by motor 88 will impart rotation to ring assembly 232 via connector band 240. Rotation of ring assembly 232 will, of course, impart rotation to stub shaft 254 that is connected thereto and also to the head portion 254*a* which is rotatably supported within bearing 260. However, because the axis of threaded bore 255 is radially offset from the true center point "CP" of the ring assembly 232, a substantial vibratory motion will result as the ring assembly is rapidly rotated. This vibratory motion is transmitted to bearing 258 and also to platen assembly 80 causing a novel circular, orbit-like motion to be imparted to the platen assembly. As in the earlier described embodiment of the invention, this orbit-like motion coupled with the reciprocal motion of the platen assembly performs a superior finishing operation on the material residing beneath the platen with which the platen is in engagement. Because of the offset of threaded bore 255, as ring assembly 232 rapidly rotates, it will travel in a path diagrammatically depicted in FIG. 31 causing the platen assembly to vibrate in a orbit-like motion as indicated by the letters A, B, and C of FIG. 31. The flexible connector bands 240 of the apparatus function in a highly novel manner to transfer rotary motion from shaft 230 to the vibratory mechanism and also uniquely function to isolate shaft 230 from vibration.

As was the case in the earlier described embodiment of the invention, motor 88 is disposed intermediate orbital generators 224 and 226. As previously mentioned electric motor 88, which comprises the means for rotating shafts 230 of both of the orbital generators which shafts are rotatably connected to platform 57 by bearing assemblies 89.

As previously mentioned, the surface preparing apparatus of the invention includes four longitudinally spaced surface finishing subsystems, each of which is substantially identical to surface finishing subsystem 222. These four surface finishing subsystems are disposed above the conveyor belt 36 of the vacuum type conveyor system of the invention and are longitudinally spaced along the length thereof. Each of these finishing subsystems includes a platen assembly 80.

The platen assembly 80 of this latest form of the apparatus of the invention, is substantially identical to that earlier described.

Platen assembly 80 is interconnected with platform 57 in the same manner as previously described by a plurality of novel resilient connector means of the character best seen in FIG. 25 and there generally designated by the numeral 180. These novel, resilient connector means, each of which is of identical construction, and their manner of interconnection with the platen, has been described in connection with the embodiment of the invention shown in FIGS. 1 through 23.

Figure 35:
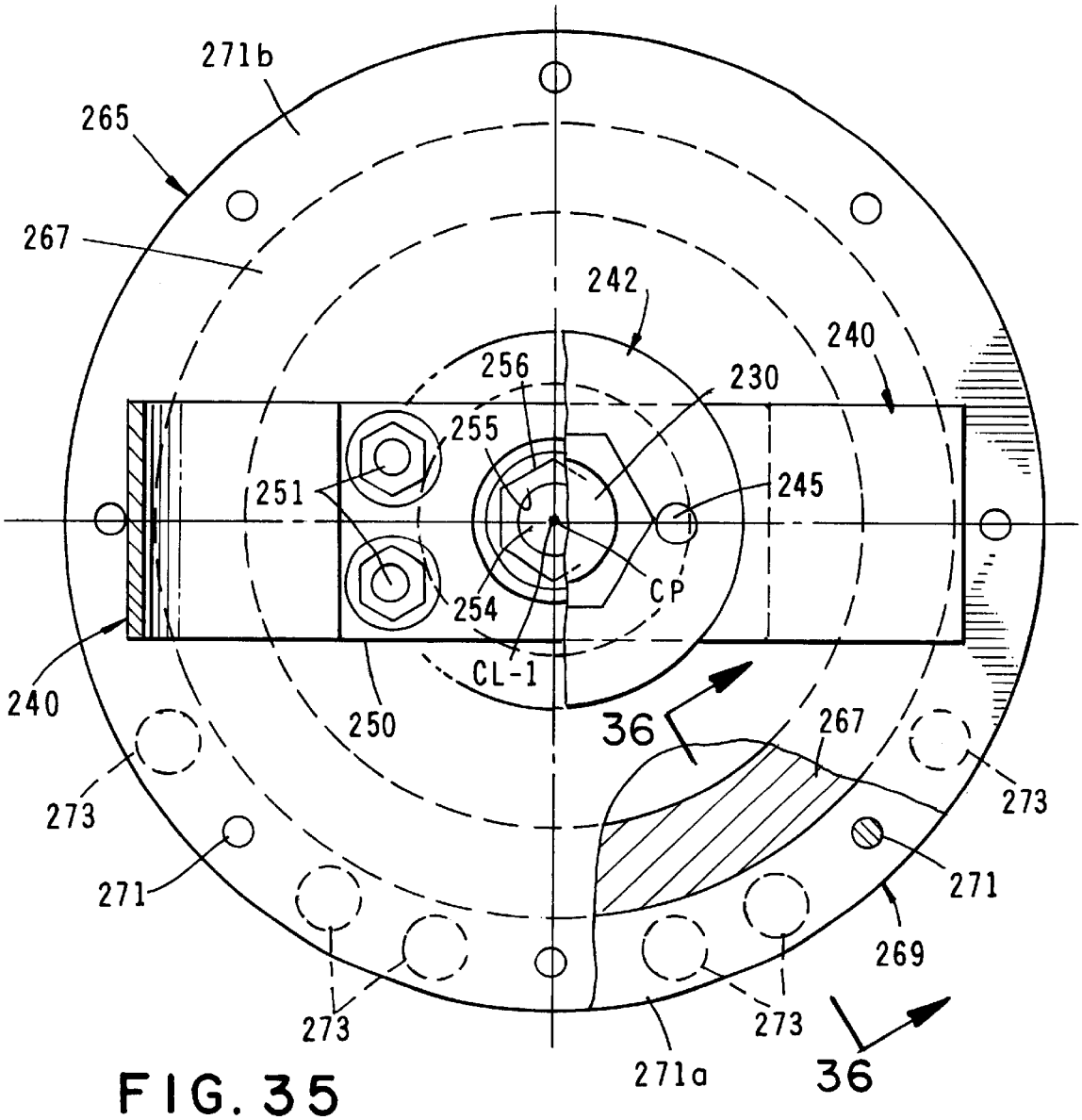
FIG. 35 is an enlarged top plan view of the alternate form of vibratory motion imparting means shown in FIG. 34, partly broken away to show internal construction.
Figure 36:
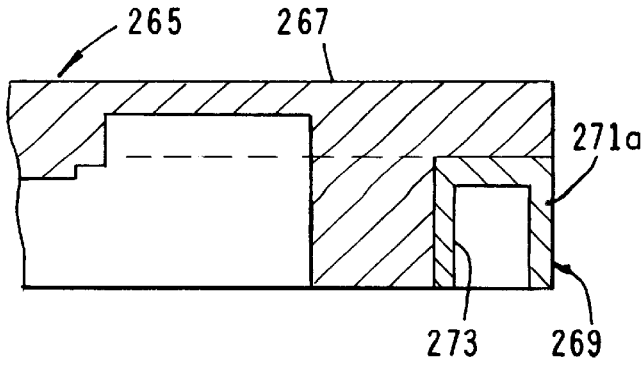
FIG. 36 is an enlarged cross-sectional view taken along lines 36—36 of FIG. 35.

In operating the apparatus of this latest form of the invention, the workpiece "W", which may be, by way of example, a cabinet door, is placed on the apertured conveyor in the manner shown in FIG. 25. As before, during the surface preparation operations, each of the platens of the sanding subsystem roll along the workpiece via sets of work engaging rollers 207 provided on the platens Turning to FIGS. 34, 35, and 36, still another form of the vibrating motion imparting means of the invention is there shown. This latest form of the invention is similar in many respects to that shown in FIGS. 24 through 33 and like numerals are used to identify like components. However, in the form of the invention shown in FIGS. 34–36, the threaded bore formed in the ring assembly, rather than being offset is rotated coaxially aligned with the center point of the ring assembly. Accordingly, the vibratory motion is achieved by making the first and second segments of the ring portion of the ring assembly of different weights. This, of course, was the same technique used to obtain the vibratory motion in the embodiment of the invention shown in FIGS. 1 through 23. Thusly, the basic difference between this latest form of the invention and the first described form of the invention resides in the provision of the novel connector band 240 which is identical to that described in connection with FIGS. 24 through 33.

Figure 34:
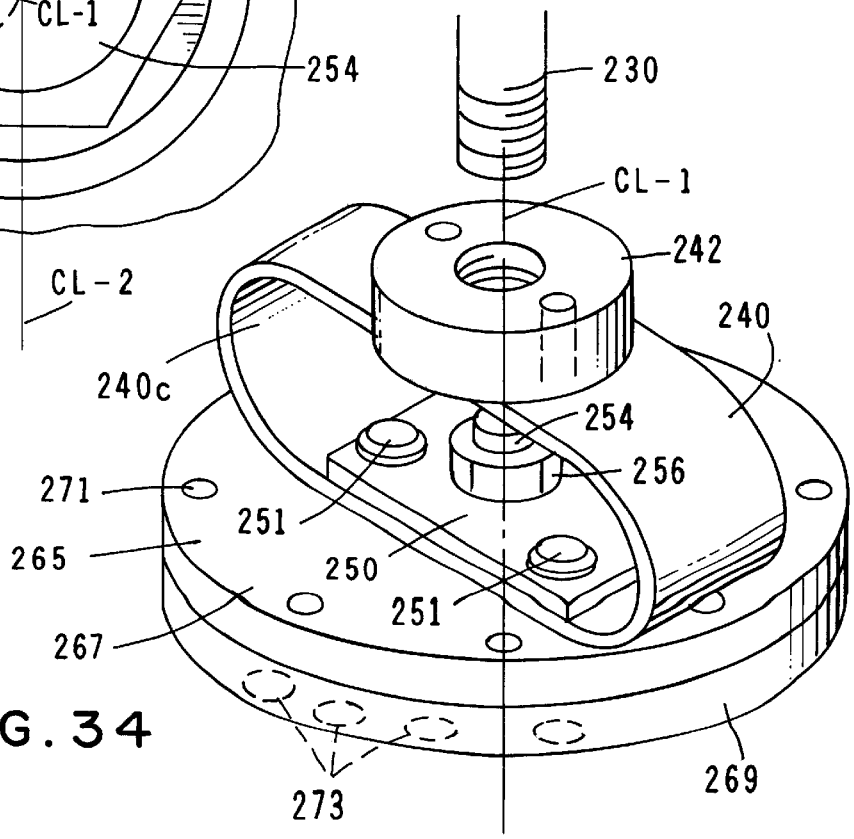
FIG. 34 is an enlarged, generally perspective view of an alternate form of the vibratory motion imparting means of the invention.

Referring particularly to FIG. 34, the ring assembly, which is there identified by the numeral 265, comprises a base plate 267 and a ring 269 that is connected thereto by suitable connectors 271. In this instance, the center point "CP" of the ring assembly 265 is coaxially aligned with the axial centerline of both shaft 230 and stub shaft 254 which is connected thereto in the manner previously described. However, as was the case with ring 118*b* of the first embodiment of the invention, the first segment 271*a* of ring 271 is provided with a plurality of circumferentially spaced drilled bores 273 while second segment 271*b* is not (FIG.

35). This, of course, makes segment 271*a* lighter than segment 271*b* so that, upon rapid rotation of ring assembly 265 by shaft 230 and via connector band 240 vibration will occur in the same manner as in the first form of the invention and will be transmitted to the platen in the manner earlier described.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. A surface preparing apparatus including a platen, said apparatus comprising:

(a) motion-imparting means operably associated with said platen for imparting an orbit-like motion thereto, said motion-imparting means comprising a ring assembly having an axial center line and including a base and a ring connected to said base, said ring having a first peripheral portion and a second peripheral portion; and (b) rotation-imparting means for imparting rotation to said ring assembly comprising:

(i) a rotating shaft having an axial center line; and (ii) interface means for interconnecting said rotating shaft with said ring assembly comprising a yieldably deformable connector band disposed between said shaft and said ring assembly.

2. The apparatus as defined in claim 1 in which said connector band comprises an endless band having an upper wall, a lower wall and spaced apart, curved end walls connected to said upper and lower walls.

3. The apparatus as defined in claim 2 in which said interface means further comprises a connector ring for connecting said connector band to said shaft and a connector plate for connecting said connector band to said ring assembly.

4. The apparatus as defined in claim 1 in which said axial center line of said rotating shaft is aligned with said axial center line of said ring assembly and in which said first segment of said ring has a weight less than said second segment.

5. The apparatus as defined in claim 1, in which said base of said ring assembly is provided with a threaded bore having an axial center line off set from said axial center line of said ring assembly.

6. The apparatus as defined in claim 1 further including a frame and motion-imparting means carried by said frame for imparting reciprocal motion to the platen.

7. The apparatus as defined in claim 1 further including a frame and a platform connected to said frame, said rotating shaft being mounted on said platform, said platform being interconnected with the platen by resilient connector means.

8. The apparatus as defined in claim 7 in which said resilient connector means comprises an elastomeric tubular member.

9. A surface preparing device including a platen, said apparatus comprising:

(a) a motion-imparting means operably associated with said platen for imparting an orbit-like motion thereto, said motion-imparting means comprising a ring having a first peripheral portion defining a first arcuate segment and a second peripheral portion defining a second arcuate segment, said second arcuate segment having a weight less than the weight of said first arcuate segment; and (b) rotation-imparting means for imparting rotation to said ring comprising:

(i) a rotating shaft; and (ii) interface means for interconnecting said rotating shaft with said ring comprising a yieldably deformable connector band member disposed between said shaft and said ring.

10. The apparatus as defined in claim 9 further including a frame and motion-imparting means carried by said frame for imparting reciprocal motion to said platen.

11. The apparatus as defined in claim 9 in which said connector band comprises an endless band having an upper wall, a lower wall and spaced apart, curved end walls connected to said upper and lower walls.

12. The apparatus as defined in claim 11 in which said interface means further comprises a first connector assembly for connecting said connector band to said shaft and a second connector assembly for connecting said connector band to said ring.

13. The apparatus as defined in claim 11 further including a frame and a platform connected to said frame, said rotating shaft being mounted on said platform, said platform being interconnected with said platen by resilient connector means.

14. The apparatus as defined in claim 13 in which said resilient connector means comprises an elastomeric tubular member.

15. A surface preparation device including a platen assembly, said device comprising:

(a) a frame;

(b) a platform connected to said frame for reciprocal movement with respect thereto;

(c) a motor connected to said platform;

(d) a straight shaft rotatable by said motor, said straight shaft having an axis of rotation;

(e) a yieldably deformable connector band connected to said straight shaft, said connector band having a top wall, a bottom wall and spaced apart side walls connected to said top and bottom walls;

(f) a ring assembly connected to said connector band, said ring assembly having first and second arcuate segments and an axial center line;

and (g) connector means for interconnecting said ring with said platen for imparting an orbit-like motion thereto.

16. The device as defined in claim 15 in which said connector band comprises an endless band and in which said interface assembly comprises a first connector for interconnecting said bottom wall of said connector band with said ring.

17. The device as defined in claim 15 in which said ring assembly is provided with a threaded bore and in which said platen assembly includes a bearing.

18. The device as defined in claim 17, in which said connector means comprises a connector shaft having an end portion rotatable within said bearing, said connector shaft being threadably received within said threaded bore.

19. The device as defined in claim 18 in which said threaded bore is offset from said axial centerline of said ring assembly.

20. The device as defined in claim 18 in which said threaded bore is coaxially aligned with said threaded bore and in which said first arcuate segment of said ring assembly has a lesser weight than said second arcuate segment.

* * * * *